US010395663B2

(12) United States Patent
Sung et al.

(10) Patent No.: US 10,395,663 B2
(45) Date of Patent: Aug. 27, 2019

(54) SIGNAL ENCODING METHOD AND APPARATUS, AND SIGNAL DECODING METHOD AND APPARATUS

(71) Applicant: SAMSUNG ELECTRONICS CO., LTD., Suwon-si (KR)

(72) Inventors: Ho-sang Sung, Yongin-si (KR); Konstantin Osipov, Saint-Petersburg (RU); Yi Lu, Beijing (CN)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/119,558

(22) PCT Filed: Feb. 17, 2015

(86) PCT No.: PCT/KR2015/001668
§ 371 (c)(1),
(2) Date: Aug. 17, 2016

(87) PCT Pub. No.: WO2015/122752
PCT Pub. Date: Aug. 20, 2015

(65) Prior Publication Data

US 2017/0061976 A1 Mar. 2, 2017

Related U.S. Application Data

(60) Provisional application No. 61/940,798, filed on Feb. 17, 2014, provisional application No. 62/029,736, filed on Jul. 28, 2014.

(51) Int. Cl.
*G10L 19/00* (2013.01)
*G10L 19/02* (2013.01)
(Continued)

(52) U.S. Cl.
CPC ..... *G10L 19/0212* (2013.01); *G10L 19/032* (2013.01); *G10L 19/038* (2013.01);
(Continued)

(58) Field of Classification Search
CPC ... G10L 19/0212; G10L 19/032; G10L 19/22; G10L 19/12; G10L 19/038; G10L 19/24;
(Continued)

(56) References Cited

U.S. PATENT DOCUMENTS 5,832,424 A 11/1998 Tsutsui
6,847,684 B1 * 1/2005 Hsu ..... H04N 19/176 375/240.01
(Continued)

FOREIGN PATENT DOCUMENTS

CN 1905010 A 1/2007
CN 103106902 A 5/2013
(Continued)

OTHER PUBLICATIONS

3rd Generation Partnership Project; Technical Specification Group Services and System Aspects; Codec for Enhanced Voice Services (EVS); Detailed Algorithmic Description (Release 12), 3GPP Standard; 3GPP TS 26.445, 3rd Generation Partnership Project (3GPP), vol. SA WG4, No. V12.0.0, (2014), (pp. 270-408).
(Continued)

*Primary Examiner* — Thierry L Pham
(74) *Attorney, Agent, or Firm* — Sughrue Mion, PLLC

(57) ABSTRACT

The present invention relates to a method and an apparatus for encoding and decoding spectrum coefficients in the frequency domain. The spectrum encoding method may comprise the steps of: selecting an encoding type on the basis of bit allocation information of respective bands; performing zero encoding with respect to a zero band; and encoding information of selected significant frequency com-
(Continued)

ponents with respect to respective non-zero bands. The spectrum encoding method enables encoding and decoding of spectrum coefficients which is adaptive to various bit-rates and various sub-band sizes. In addition, a spectrum can be encoded using a TCQ method at a fixed bit rate using a bit-rate control module in a codec that supports multiple rates. Encoding performance of the codec can be maximised by encoding high performance TCQ at a precise target bit rate.

4 Claims, 26 Drawing Sheets

(51) Int. Cl.

| | |
|---|---|
| ***G10L 19/24*** | (2013.01) |
| ***G10L 19/038*** | (2013.01) |
| ***G10L 19/12*** | (2013.01) |
| ***G10L 19/22*** | (2013.01) |
| ***G10L 19/032*** | (2013.01) |
| *G10L 21/00* | (2013.01) |
| *G10L 19/002* | (2013.01) |
| *G10L 19/20* | (2013.01) |

(52) U.S. Cl.
CPC ..... *G10L 19/12* (2013.01); *G10L 19/22* (2013.01); *G10L 19/24* (2013.01); *G10L 19/002* (2013.01); *G10L 19/20* (2013.01); *G10L 2019/0016* (2013.01)

(58) Field of Classification Search
CPC ..... G10L 19/20; G10L 2019/0016; G10L 19/002
USPC ..... 704/500, 501, 503, 504
See application file for complete search history.

(56) References Cited

U.S. PATENT DOCUMENTS

| | | | |
|---|---|---|---|
| 7,483,836 | B2 | 1/2009 | Taori et al. |
| 7,605,727 | B2 | 10/2009 | Sung et al. |
| 8,527,265 | B2 | 9/2013 | Reznik et al. |
| 8,566,105 | B2 | 10/2013 | Onuma et al. |
| 8,615,391 | B2 | 12/2013 | Kim et al. |
| 2003/0061055 | A1 | 3/2003 | Taori et al. |
| 2007/0016404 | A1 | 1/2007 | Kim et al. |
| 2007/0043575 | A1 | 2/2007 | Onuma et al. |
| 2013/0290003 | A1 | 10/2013 | Choo |
| 2014/0303965 | A1* | 10/2014 | Lee ..... G10L 19/002 704/201 |

FOREIGN PATENT DOCUMENTS

| | | | |
|---|---|---|---|
| EP | 1798724 | A1 | 6/2007 |
| EP | 3176780 | A1 | 6/2017 |
| JP | 7-168593 | A | 7/1995 |
| JP | 2004-522198 | A | 7/2004 |
| JP | 2011-501828 | A | 1/2011 |
| KR | 10-0851970 | B1 | 8/2008 |
| WO | 01/50613 | A1 | 7/2001 |
| WO | 2013/062392 | A1 | 5/2013 |

OTHER PUBLICATIONS 6.2 MDCT Coding mode decoding, 3GPP Draft; 26445-C10_9_S0602_S0607, 3rd Generation Partnership Project (3GPP), 3GPP TS 26.445 V1 2.0.0, (2014), (pp. 520-606).
Communication dated Jul. 27, 2017, issued by the European Patent Office in counterpart European Application No. 15749031.9.
International Search Report dated Apr. 30, 2015 issued by International Searching Authority in counterpart International Application No. PCT/KR2015/001668 (PCT/ISA/210).
Written Opinion dated Apr. 30, 2015 issued by International Searching Authority in counterpart International Application No. PCT/KR2015/001668 (PCT/ISA/237).
Communication dated Jan. 22, 2019, issued by the Japanese Patent Office in counterpart Japanese Application No. 2016-569544.
Udar Mittal et al. "Coding Pulse Sequences Using a Combination of Factorial Pulse Coding and Arithmetic Coding", Proceedings of 2010 International Conference on Signal Processing and Communications, Jul. 2010 (6 pages total).
Communication dated May 15, 2019 issued by the European Patent Office in counterpart European Application No. 15749031.9.

* cited by examiner

SIGNAL ENCODING METHOD AND APPARATUS, AND SIGNAL DECODING METHOD AND APPARATUS

TECHNICAL FIELD

One or more exemplary embodiments relate to audio or speech signal encoding and decoding, and more particularly, to a method and apparatus for encoding or decoding a spectral coefficient in a frequency domain.

BACKGROUND ART

Quantizers of various schemes have been proposed to efficiently encode spectral coefficients in a frequency domain. For example, there are trellis coded quantization (TCQ), uniform scalar quantization (USQ), factorial pulse coding (FPC), algebraic VQ (AVQ), pyramid VQ (PVQ), and the like, and a lossless encoder optimized for each quantizer may be implemented together.

DETAILED DESCRIPTION OF THE INVENTION

Technical Problem

One or more exemplary embodiments include a method and apparatus for encoding or decoding a spectral coefficient adaptively to various bit rates or various sub-band sizes in a frequency domain.

One or more exemplary embodiments include a computer-readable recording medium having recorded thereon a computer-readable program for executing a signal encoding or decoding method.

One or more exemplary embodiments include a multimedia device employing a signal encoding or decoding apparatus.

Technical Solution

According to one or more exemplary embodiments, a spectrum encoding method includes: selecting an encoding method based on at least bit allocation information of each band; performing zero encoding on a zero band; and encoding information about important frequency components selected for each non-zero band.

According to one or more exemplary embodiments, a spectrum decoding method includes: selecting a decoding method based on at least bit allocation information of each band; performing zero decoding on a zero band; and decoding information about important frequency components obtained for each non-zero band.

Advantageous Effects of the Invention

Encoding and decoding of a spectral coefficient adaptive to various bit rates and various sub-band sizes can be performed. In addition, a spectrum can be encoded at a fixed bit rate by means of TCQ by using a bit rate control module designed in a multi-rate supporting codec. In this case, the encoding performance of the codec can be maximized by performing encoding at an accurate target bit rate through the high performance of TCQ.

MODE OF THE INVENTION

Figure 1A:
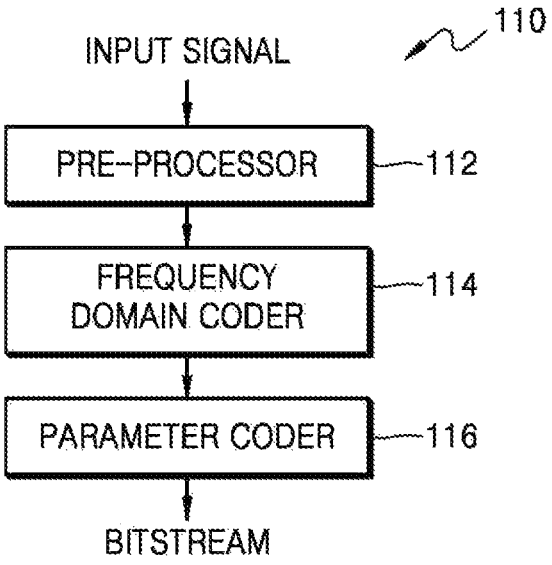
FIGS. 1A and 1B are block diagrams of an audio encoding apparatus and an audio decoding apparatus according to an exemplary embodiment, respectively.

Since the inventive concept may have diverse modified embodiments, preferred embodiments are illustrated in the drawings and are described in the detailed description of the inventive concept. However, this does not limit the inventive concept within specific embodiments and it should be understood that the inventive concept covers all the modifications, equivalents, and replacements within the idea and technical scope of the inventive concept. Moreover, detailed descriptions related to well-known functions or configurations will be ruled out in order not to unnecessarily obscure subject matters of the inventive concept.

It will be understood that although the terms of first and second are used herein to describe various elements, these elements should not be limited by these terms. Terms are only used to distinguish one component from other components.

In the following description, the technical terms are used only for explain a specific exemplary embodiment while not limiting the inventive concept. Terms used in the inventive concept have been selected as general terms which are widely used at present, in consideration of the functions of the inventive concept, but may be altered according to the intent of an operator of ordinary skill in the art, conventional practice, or introduction of new technology. Also, if there is a term which is arbitrarily selected by the applicant in a specific case, in which case a meaning of the term will be described in detail in a corresponding description portion of the inventive concept. Therefore, the terms should be defined on the basis of the entire content of this specification instead of a simple name of each of the terms.

The terms of a singular form may include plural forms unless referred to the contrary. The meaning of 'comprise', 'include', or 'have' specifies a property, a region, a fixed number, a step, a process, an element and/or a component but does not exclude other properties, regions, fixed numbers, steps, processes, elements and/or components.

Hereinafter, exemplary embodiments will be described in detail with reference to the accompanying drawings.

Figure 1B:
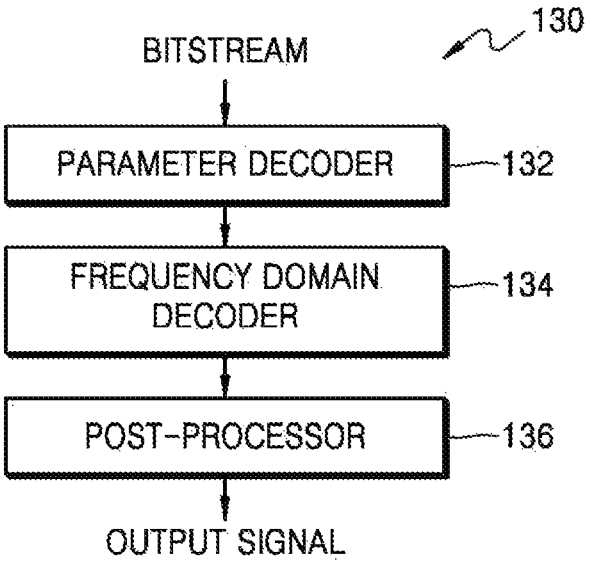

FIGS. 1A and 1B are block diagrams of an audio encoding apparatus and an audio decoding apparatus according to an exemplary embodiment, respectively.

The audio encoding apparatus 110 shown in FIG. 1A may include a pre-processor 112, a frequency domain coder 114, and a parameter coder 116. The components may be integrated in at least one module and may be implemented as at least one processor (not shown).

In FIG. 1A, the pre-processor 112 may perform filtering, down-sampling, or the like for an input signal, but is not limited thereto. The input signal may include a speech signal, a music signal, or a mixed signal of speech and music. Hereinafter, for convenience of explanation, the input signal is referred to as an audio signal.

The frequency domain coder 114 may perform a time-frequency transform on the audio signal provided by the pre-processor 112, select a coding tool in correspondence with the number of channels, a coding band, and a bit rate of the audio signal, and encode the audio signal by using the selected coding tool. The time-frequency transform may use a modified discrete cosine transform (MDCT), a modulated lapped transform (MLT), or a fast Fourier transform (FFT), but is not limited thereto. When the number of given bits is sufficient, a general transform coding scheme may be applied to the whole bands, and when the number of given bits is not sufficient, a bandwidth extension scheme may be applied to partial bands. When the audio signal is a stereo-channel or multi-channel, if the number of given bits is sufficient, encoding is performed for each channel, and if the number of given bits is not sufficient, a down-mixing scheme may be applied. An encoded spectral coefficient is generated by the frequency domain coder 114.

The parameter coder 116 may extract a parameter from the encoded spectral coefficient provided from the frequency domain coder 114 and encode the extracted parameter. The parameter may be extracted, for example, for each sub-band, which is a unit of grouping spectral coefficients, and may have a uniform or non-uniform length by reflecting a critical band. When each sub-band has a non-uniform length, a sub-band existing in a low frequency band may have a relatively short length compared with a sub-band existing in a high frequency band. The number and a length of sub-bands included in one frame vary according to codec algorithms and may affect the encoding performance. The parameter may include, for example a scale factor, power, average energy, or Norm, but is not limited thereto. Spectral coefficients and parameters obtained as an encoding result form a bitstream, and the bitstream may be stored in a storage medium or may be transmitted in a form of, for example, packets through a channel.

The audio decoding apparatus 130 shown in FIG. 1B may include a parameter decoder 132, a frequency domain decoder 134, and a post-processor 136. The frequency domain decoder 134 may include a frame error concealment algorithm or a packet loss concealment algorithm. The components may be integrated in at least one module and may be implemented as at least one processor (not shown).

In FIG. 1B, the parameter decoder 132 may decode parameters from a received bitstream and check whether an error such as erasure or loss has occurred in frame units from the decoded parameters. Various well-known methods may be used for the error check, and information on whether a current frame is a good frame or an erasure or loss frame is provided to the frequency domain decoder 134. Hereinafter, for convenience of explanation, the erasure or loss frame is referred to as an error frame.

When the current frame is a good frame, the frequency domain decoder 134 may generate synthesized spectral coefficients by performing decoding through a general transform decoding process. When the current frame is an error frame, the frequency domain decoder 134 may generate synthesized spectral coefficients by repeating spectral coefficients of a previous good frame (PGF) onto the error frame or by scaling the spectral coefficients of the PGF by a regression analysis to then be repeated onto the error frame, through a frame error concealment algorithm or a packet loss concealment algorithm. The frequency domain decoder 134 may generate a time domain signal by performing a frequency-time transform on the synthesized spectral coefficients.

The post-processor 136 may perform filtering, up-sampling, or the like for sound quality improvement with respect to the time domain signal provided from the frequency domain decoder 134, but is not limited thereto. The post-processor 136 provides a reconstructed audio signal as an output signal.

Figure 2A:
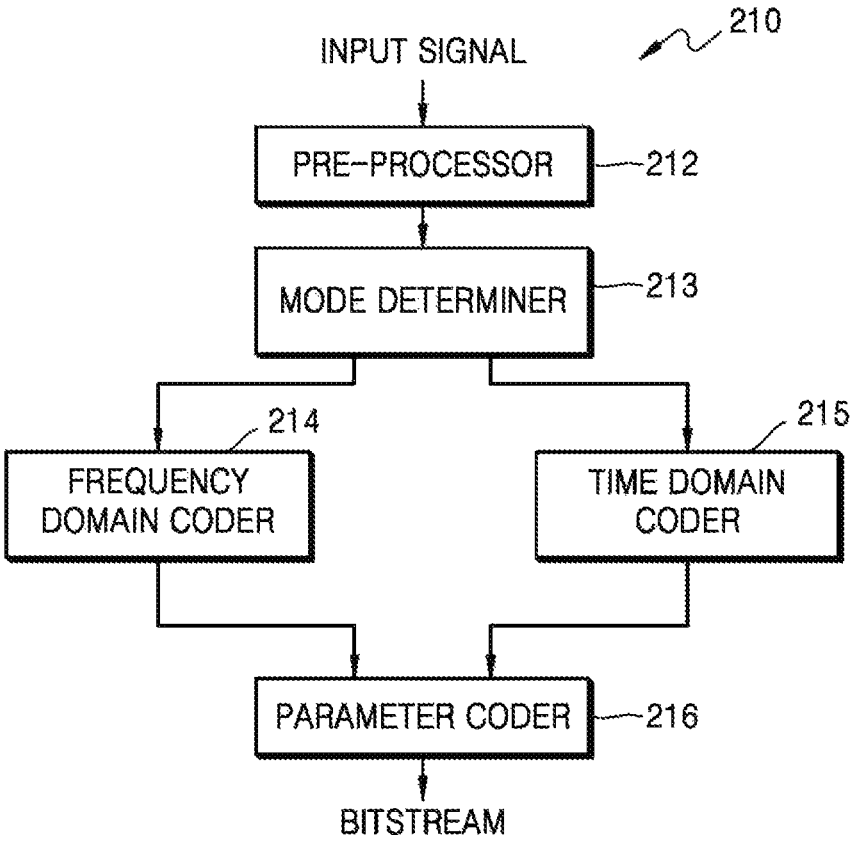
FIGS. 2A and 2B are block diagrams of an audio encoding apparatus and an audio decoding apparatus according to another exemplary embodiment, respectively.
Figure 2B:
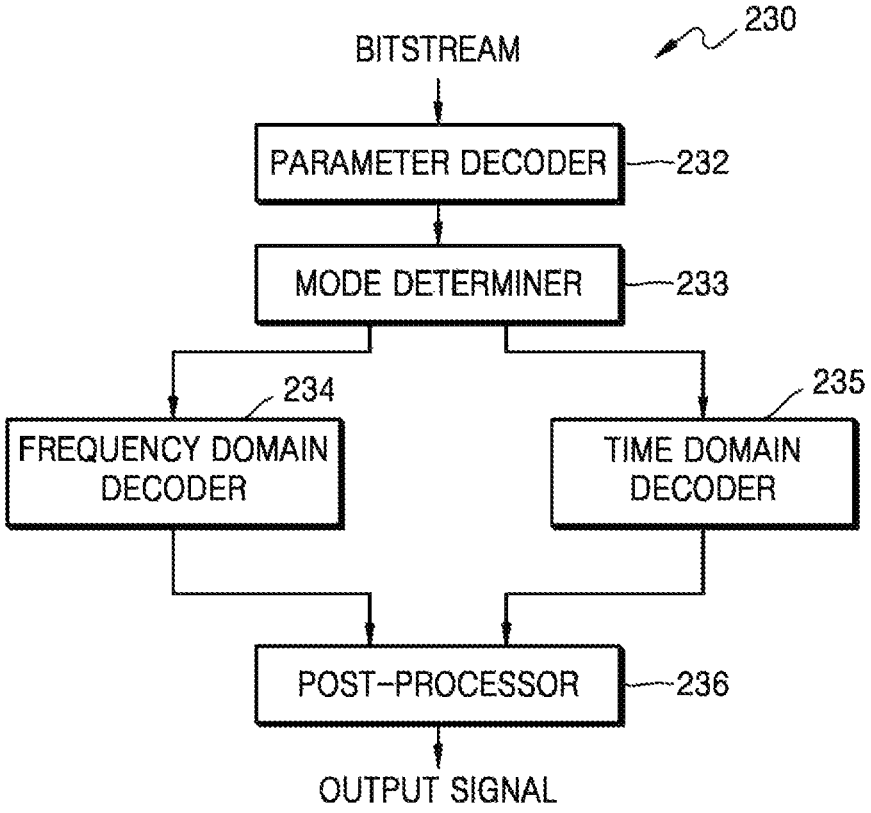

FIGS. 2A and 2B are block diagrams of an audio encoding apparatus and an audio decoding apparatus, according to another exemplary embodiment, respectively, which have a switching structure.

The audio encoding apparatus 210 shown in FIG. 2A may include a pre-processor unit 212, a mode determiner 213, a frequency domain coder 214, a time domain coder 215, and a parameter coder 216. The components may be integrated in at least one module and may be implemented as at least one processor (not shown).

In FIG. 2A, since the pre-processor 212 is substantially the same as the pre-processor 112 of FIG. 1A, the description thereof is not repeated.

The mode determiner 213 may determine a coding mode by referring to a characteristic of an input signal. The mode determiner 213 may determine according to the characteristic of the input signal whether a coding mode suitable for a current frame is a speech mode or a music mode and may also determine whether a coding mode efficient for the current frame is a time domain mode or a frequency domain mode. The characteristic of the input signal may be perceived by using a short-term characteristic of a frame or a long-term characteristic of a plurality of frames, but is not limited thereto. For example, if the input signal corresponds to a speech signal, the coding mode may be determined as the speech mode or the time domain mode, and if the input signal corresponds to a signal other than a speech signal, i.e., a music signal or a mixed signal, the coding mode may be determined as the music mode or the frequency domain mode. The mode determiner 213 may provide an output signal of the pre-processor 212 to the frequency domain coder 214 when the characteristic of the input signal corresponds to the music mode or the frequency domain mode and may provide an output signal of the pre-processor 212 to the time domain coder 215 when the characteristic of the input signal corresponds to the speech mode or the time domain mode.

Since the frequency domain coder 214 is substantially the same as the frequency domain coder 114 of FIG. 1A, the description thereof is not repeated.

The time domain coder 215 may perform code excited linear prediction (CELP) coding for an audio signal provided from the pre-processor 212. In detail, algebraic CELP may be used for the CELP coding, but the CELP coding is not limited thereto. An encoded spectral coefficient is generated by the time domain coder 215.

The parameter coder 216 may extract a parameter from the encoded spectral coefficient provided from the frequency domain coder 214 or the time domain coder 215 and encodes the extracted parameter. Since the parameter coder 216 is substantially the same as the parameter coder 116 of FIG. 1A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 230 shown in FIG. 2B may include a parameter decoder 232, a mode determiner 233, a frequency domain decoder 234, a time domain decoder 235, and a post-processor 236. Each of the frequency domain decoder 234 and the time domain decoder 235 may include a frame error concealment algorithm or a packet loss concealment algorithm in each corresponding domain. The components may be integrated in at least one module and may be implemented as at least one processor (not shown).

In FIG. 2B, the parameter decoder 232 may decode parameters from a bitstream transmitted in a form of packets and check whether an error has occurred in frame units from the decoded parameters. Various well-known methods may be used for the error check, and information on whether a current frame is a good frame or an error frame is provided to the frequency domain decoder 234 or the time domain decoder 235.

The mode determiner 233 may check coding mode information included in the bitstream and provide a current frame to the frequency domain decoder 234 or the time domain decoder 235.

The frequency domain decoder 234 may operate when a coding mode is the music mode or the frequency domain mode and generate synthesized spectral coefficients by performing decoding through a general transform decoding process when the current frame is a good frame. When the current frame is an error frame, and a coding mode of a previous frame is the music mode or the frequency domain mode, the frequency domain decoder 234 may generate synthesized spectral coefficients by repeating spectral coefficients of a previous good frame (PGF) onto the error frame or by scaling the spectral coefficients of the PGF by a regression analysis to then be repeated onto the error frame, through a frame error concealment algorithm or a packet loss concealment algorithm. The frequency domain decoder 234 may generate a time domain signal by performing a frequency-time transform on the synthesized spectral coefficients.

The time domain decoder 235 may operate when the coding mode is the speech mode or the time domain mode and generate a time domain signal by performing decoding through a general CELP decoding process when the current frame is a normal frame. When the current frame is an error frame, and the coding mode of the previous frame is the speech mode or the time domain mode, the time domain decoder 235 may perform a frame error concealment algorithm or a packet loss concealment algorithm in the time domain.

The post-processor 236 may perform filtering, up-sampling, or the like for the time domain signal provided from the frequency domain decoder 234 or the time domain decoder 235, but is not limited thereto. The post-processor 236 provides a reconstructed audio signal as an output signal.

Figure 3A:
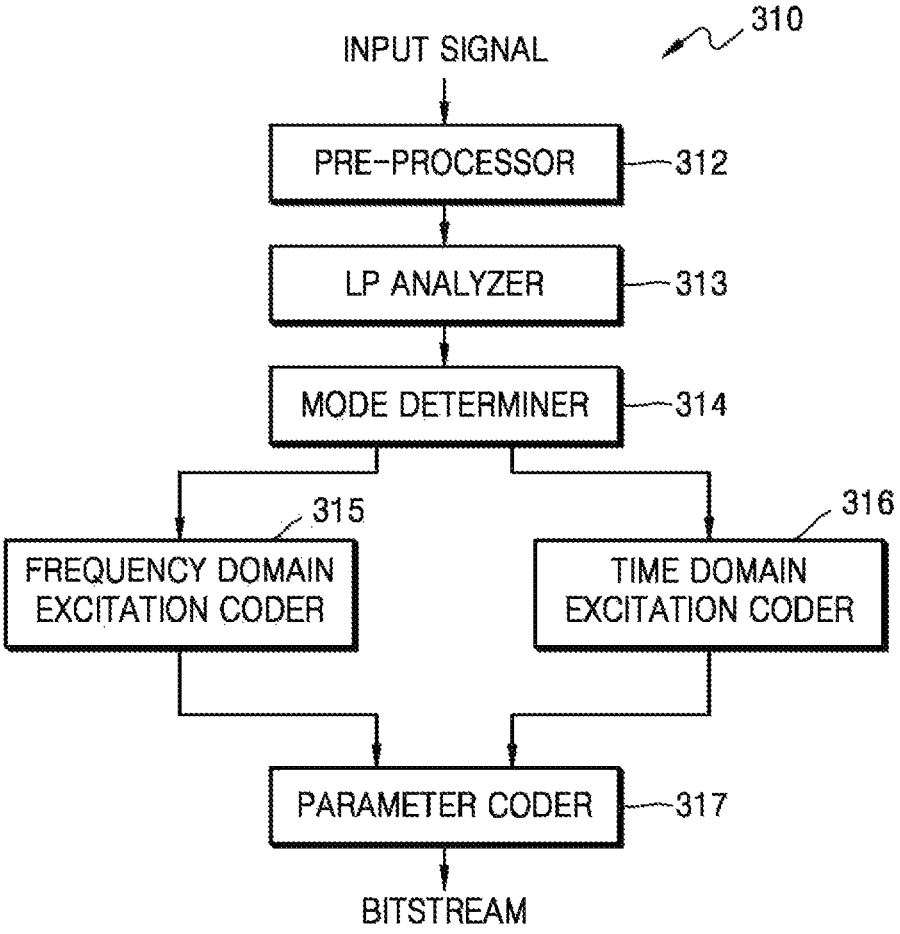
FIGS. 3A and 3B are block diagrams of an audio encoding apparatus and an audio decoding apparatus according to another exemplary embodiment, respectively.
Figure 3B:
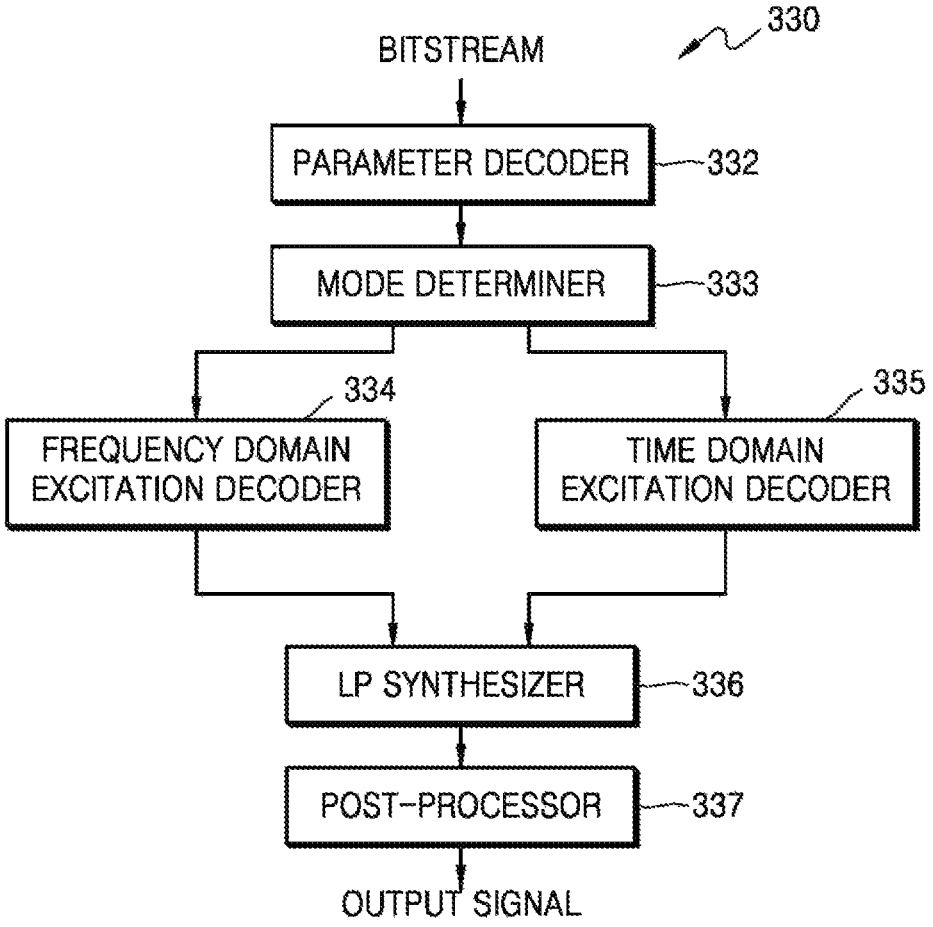

FIGS. 3A and 3B are block diagrams of an audio encoding apparatus and an audio decoding apparatus according to another exemplary embodiment, respectively.

The audio encoding apparatus 310 shown in FIG. 3A may include a pre-processor 312, a linear prediction (LP) analyzer 313, a mode determiner 314, a frequency domain excitation coder 315, a time domain excitation coder 316, and a parameter coder 317. The components may be integrated in at least one module and may be implemented as at least one processor (not shown).

In FIG. 3A, since the pre-processor 312 is substantially the same as the pre-processor 112 of FIG. 1A, the description thereof is not repeated.

The LP analyzer 313 may extract LP coefficients by performing LP analysis for an input signal and generate an excitation signal from the extracted LP coefficients. The excitation signal may be provided to one of the frequency domain excitation coder unit 315 and the time domain excitation coder 316 according to a coding mode.

Since the mode determiner 314 is substantially the same as the mode determiner 213 of FIG. 2A, the description thereof is not repeated.

The frequency domain excitation coder 315 may operate when the coding mode is the music mode or the frequency domain mode, and since the frequency domain excitation coder 315 is substantially the same as the frequency domain coder 114 of FIG. 1A except that an input signal is an excitation signal, the description thereof is not repeated.

The time domain excitation coder 316 may operate when the coding mode is the speech mode or the time domain mode, and since the time domain excitation coder unit 316 is substantially the same as the time domain coder 215 of FIG. 2A, the description thereof is not repeated.

The parameter coder 317 may extract a parameter from an encoded spectral coefficient provided from the frequency domain excitation coder 315 or the time domain excitation coder 316 and encode the extracted parameter. Since the parameter coder 317 is substantially the same as the parameter coder 116 of FIG. 1A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 330 shown in FIG. 3B may include a parameter decoder 332, a mode determiner 333, a frequency domain excitation decoder 334, a time domain excitation decoder 335, an LP synthesizer 336, and a post-processor 337. Each of the frequency domain excitation decoder 334 and the time domain excitation decoder 335 may include a frame error concealment algorithm or a packet loss concealment algorithm in each corresponding domain. The components may be integrated in at least one module and may be implemented as at least one processor (not shown).

In FIG. 3B, the parameter decoder 332 may decode parameters from a bitstream transmitted in a form of packets and check whether an error has occurred in frame units from the decoded parameters. Various well-known methods may be used for the error check, and information on whether a current frame is a good frame or an error frame is provided to the frequency domain excitation decoder 334 or the time domain excitation decoder 335.

The mode determiner 333 may check coding mode information included in the bitstream and provide a current frame to the frequency domain excitation decoder 334 or the time domain excitation decoder 335.

The frequency domain excitation decoder 334 may operate when a coding mode is the music mode or the frequency domain mode and generate synthesized spectral coefficients by performing decoding through a general transform decoding process when the current frame is a good frame. When the current frame is an error frame, and a coding mode of a previous frame is the music mode or the frequency domain mode, the frequency domain excitation decoder 334 may generate synthesized spectral coefficients by repeating spectral coefficients of a previous good frame (PGF) onto the error frame or by scaling the spectral coefficients of the PGF by a regression analysis to then be repeated onto the error frame, through a frame error concealment algorithm or a packet loss concealment algorithm. The frequency domain excitation decoder 334 may generate an excitation signal that is a time domain signal by performing a frequency-time transform on the synthesized spectral coefficients.

The time domain excitation decoder 335 may operate when the coding mode is the speech mode or the time domain mode and generate an excitation signal that is a time domain signal by performing decoding through a general CELP decoding process when the current frame is a good frame. When the current frame is an error frame, and the coding mode of the previous frame is the speech mode or the time domain mode, the time domain excitation decoder 335 may perform a frame error concealment algorithm or a packet loss concealment algorithm in the time domain.

The LP synthesizer 336 may generate a time domain signal by performing LP synthesis for the excitation signal provided from the frequency domain excitation decoder 334 or the time domain excitation decoder 335.

The post-processor 337 may perform filtering, up-sampling, or the like for the time domain signal provided from the LP synthesizer 336, but is not limited thereto. The post-processor 337 provides a reconstructed audio signal as an output signal.

Figure 4A:
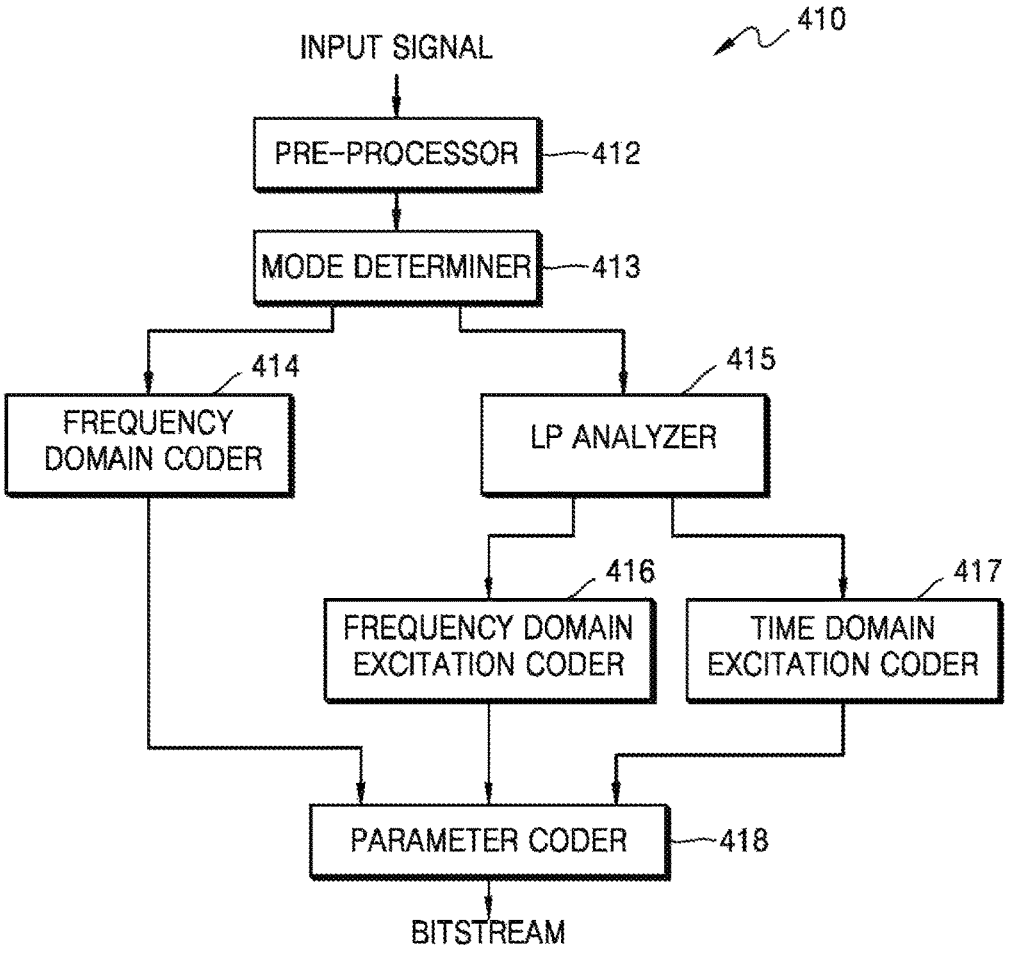
FIGS. 4A and 4B are block diagrams of an audio encoding apparatus and an audio decoding apparatus according to another exemplary embodiment, respectively.
Figure 4B:
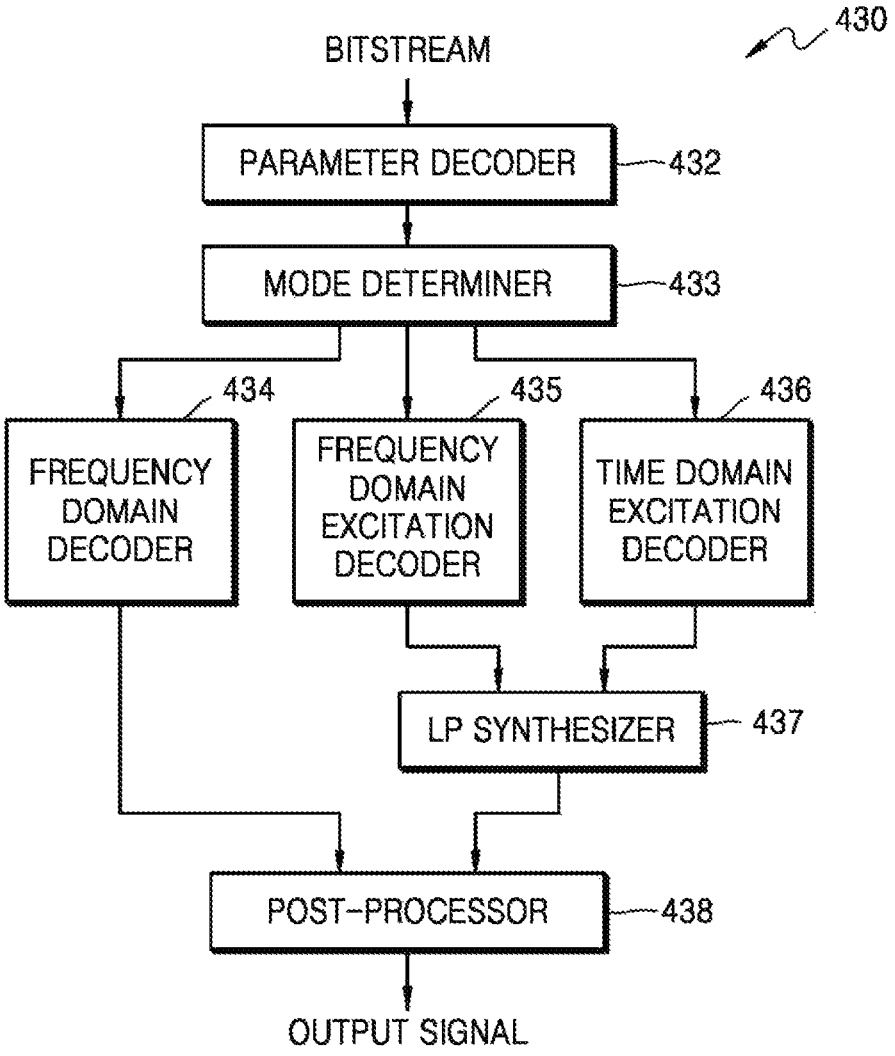

FIGS. 4A and 4B are block diagrams of an audio encoding apparatus and an audio decoding apparatus according to another exemplary embodiment, respectively, which have a switching structure.

The audio encoding apparatus 410 shown in FIG. 4A may include a pre-processor 412, a mode determiner 413, a frequency domain coder 414, an LP analyzer 415, a frequency domain excitation coder 416, a time domain excitation coder 417, and a parameter coder 418. The components may be integrated in at least one module and may be implemented as at least one processor (not shown). Since it can be considered that the audio encoding apparatus 410 shown in FIG. 4A is obtained by combining the audio encoding apparatus 210 of FIG. 2A and the audio encoding apparatus 310 of FIG. 3A, the description of operations of common parts is not repeated, and an operation of the mode determination unit 413 will now be described.

The mode determiner 413 may determine a coding mode of an input signal by referring to a characteristic and a bit rate of the input signal. The mode determiner 413 may determine the coding mode as a CELP mode or another mode based on whether a current frame is the speech mode or the music mode according to the characteristic of the input signal and based on whether a coding mode efficient for the current frame is the time domain mode or the frequency domain mode. The mode determiner 413 may determine the coding mode as the CELP mode when the characteristic of the input signal corresponds to the speech mode, determine the coding mode as the frequency domain mode when the characteristic of the input signal corresponds to the music mode and a high bit rate, and determine the coding mode as an audio mode when the characteristic of the input signal corresponds to the music mode and a low bit rate. The mode determiner 413 may provide the input signal to the frequency domain coder 414 when the coding mode is the frequency domain mode, provide the input signal to the frequency domain excitation coder 416 via the LP analyzer 415 when the coding mode is the audio mode, and provide the input signal to the time domain excitation coder 417 via the LP analyzer 415 when the coding mode is the CELP mode.

The frequency domain coder 414 may correspond to the frequency domain coder 114 in the audio encoding apparatus 110 of FIG. 1A or the frequency domain coder 214 in the audio encoding apparatus 210 of FIG. 2A, and the frequency domain excitation coder 416 or the time domain excitation coder 417 may correspond to the frequency domain excitation coder 315 or the time domain excitation coder 316 in the audio encoding apparatus 310 of FIG. 3A.

The audio decoding apparatus 430 shown in FIG. 4B may include a parameter decoder 432, a mode determiner 433, a frequency domain decoder 434, a frequency domain excitation decoder 435, a time domain excitation decoder 436, an LP synthesizer 437, and a post-processor 438. Each of the frequency domain decoder 434, the frequency domain excitation decoder 435, and the time domain excitation decoder 436 may include a frame error concealment algorithm or a packet loss concealment algorithm in each corresponding domain. The components may be integrated in at least one module and may be implemented as at least one processor (not shown). Since it can be considered that the audio decoding apparatus 430 shown in FIG. 4B is obtained by combining the audio decoding apparatus 230 of FIG. 2B and the audio decoding apparatus 330 of FIG. 3B, the description of operations of common parts is not repeated, and an operation of the mode determiner 433 will now be described.

The mode determiner 433 may check coding mode information included in a bitstream and provide a current frame to the frequency domain decoder 434, the frequency domain excitation decoder 435, or the time domain excitation decoder 436.

The frequency domain decoder 434 may correspond to the frequency domain decoder 134 in the audio decoding apparatus 130 of FIG. 1B or the frequency domain decoder 234 in the audio encoding apparatus 230 of FIG. 2B, and the frequency domain excitation decoder 435 or the time domain excitation decoder 436 may correspond to the frequency domain excitation decoder 334 or the time domain excitation decoder 335 in the audio decoding apparatus 330 of FIG. 3B.

Figure 5:
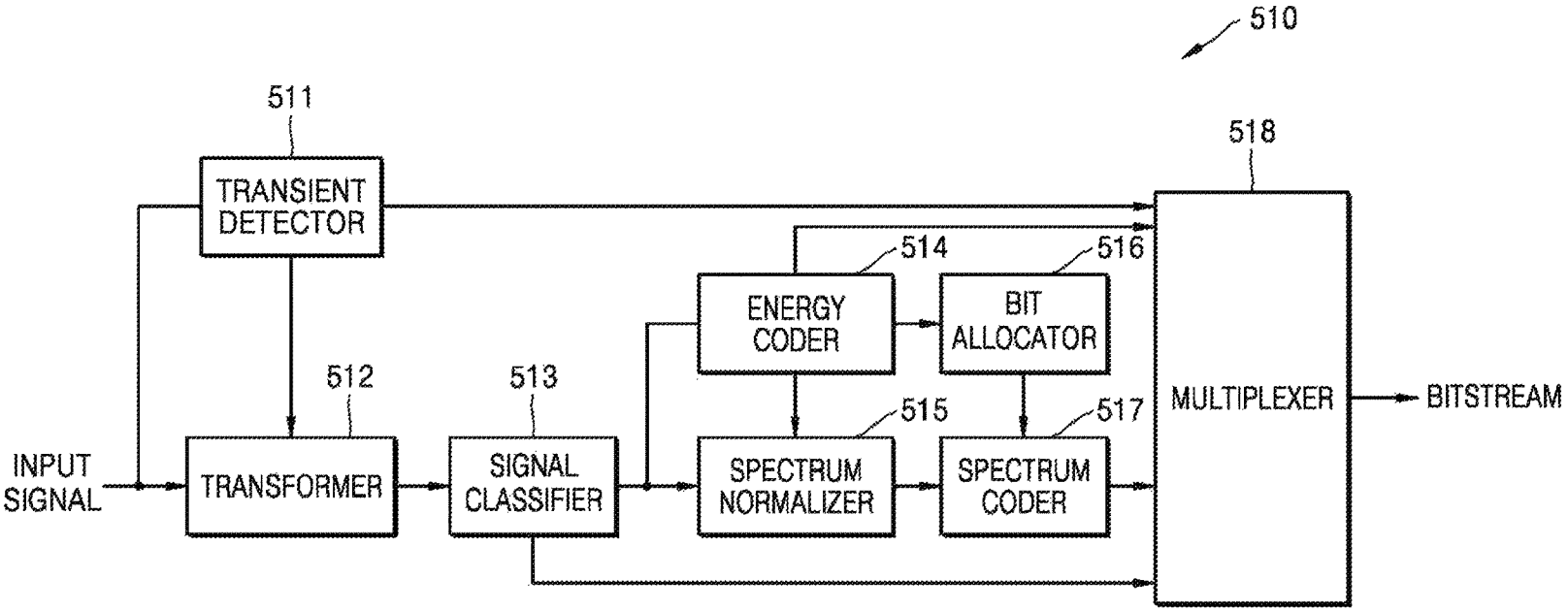
FIG. 5 is a block diagram of a frequency domain audio encoding apparatus according to an exemplary embodiment.

FIG. 5 is a block diagram of a frequency domain audio encoding apparatus according to an exemplary embodiment.

The frequency domain audio encoding apparatus 510 shown in FIG. 5 may include a transient detector 511, a transformer 512, a signal classifier 513, an energy coder 514, a spectrum normalizer 515, a bit allocator 516, a spectrum coder 517, and a multiplexer 518. The components may be integrated in at least one module and may be implemented as at least one processor (not shown). The frequency domain audio encoding apparatus 510 may perform all functions of the frequency domain audio coder 214 and partial functions of the parameter coder 216 shown in FIG. 2. The frequency domain audio encoding apparatus 510 may be replaced by a configuration of an encoder disclosed in the ITU-T G.719 standard except for the signal classifier 513, and the transformer 512 may use a transform window having an overlap duration of 50%. In addition, the frequency domain audio encoding apparatus 510 may be replaced by a configuration of an encoder disclosed in the ITU-T G.719 standard except for the transient detector 511 and the signal classifier 513. In each case, although not shown, a noise level estimation unit may be further included at a rear end of the spectrum coder 517 as in the ITU-T G.719 standard to estimate a noise level for a spectral coefficient to which a bit is not allocated in a bit allocation process and insert the estimated noise level into a bitstream.

Referring to FIG. 5, the transient detector 511 may detect a duration exhibiting a transient characteristic by analyzing an input signal and generate transient signaling information for each frame in response to a result of the detection. Various well-known methods may be used for the detection of a transient duration. According to an exemplary embodiment, the transient detector 511 may primarily determine whether a current frame is a transient frame and secondarily verify the current frame that has been determined as a transient frame. The transient signaling information may be included in a bitstream by the multiplexer 518 and may be provided to the transformer 512.

The transformer 512 may determine a window size to be used for a transform according to a result of the detection of a transient duration and perform a time-frequency transform based on the determined window size. For example, a short window may be applied to a sub-band from which a transient duration has been detected, and a long window may be applied to a sub-band from which a transient duration has not been detected. As another example, a short window may be applied to a frame including a transient duration.

The signal classifier 513 may analyze a spectrum provided from the transformer 512 in frame units to determine whether each frame corresponds to a harmonic frame. Various well-known methods may be used for the determination of a harmonic frame. According to an exemplary embodiment, the signal classifier 513 may divide the spectrum provided from the transformer 512 into a plurality of sub-bands and obtain a peak energy value and an average energy value for each sub-band. Thereafter, the signal classifier 513 may obtain the number of sub-bands of which a peak energy value is greater than an average energy value by a predetermined ratio or above for each frame and determine, as a harmonic frame, a frame in which the obtained number of sub-bands is greater than or equal to a predetermined value. The predetermined ratio and the predetermined value may be determined in advance through experiments or simulations. Harmonic signaling information may be included in the bitstream by the multiplexer 518.

The energy coder 514 may obtain energy in each sub-band unit and quantize and lossless-encode the energy. According to an embodiment, a Norm value corresponding to average spectral energy in each sub-band unit may be used as the energy and a scale factor or a power may also be used, but the energy is not limited thereto. The Norm value of each sub-band may be provided to the spectrum normalizer 515 and the bit allocator 516 and may be included in the bitstream by the multiplexer 518.

The spectrum normalizer 515 may normalize the spectrum by using the Norm value obtained in each sub-band unit.

The bit allocator 516 may allocate bits in integer units or fraction units by using the Norm value obtained in each sub-band unit. In addition, the bit allocator 516 may calculate a masking threshold by using the Norm value obtained in each sub-band unit and estimate the perceptually required number of bits, i.e., the allowable number of bits, by using the masking threshold. The bit allocator 516 may limit that the allocated number of bits does not exceed the allowable number of bits for each sub-band. The bit allocator 516 may sequentially allocate bits from a sub-band having a larger Norm value and weigh the Norm value of each sub-band according to perceptual importance of each sub-band to adjust the allocated number of bits so that a more number of bits are allocated to a perceptually important sub-band. The quantized Norm value provided from the energy coder 514 to the bit allocator 516 may be used for the bit allocation after being adjusted in advance to consider psychoacoustic weighting and a masking effect as in the ITU-T G.719 standard.

The spectrum coder 517 may quantize the normalized spectrum by using the allocated number of bits of each sub-band and lossless-encode a result of the quantization. For example, TCQ, USQ, FPC, AVQ and PVQ or a combination thereof and a lossless encoder optimized for each quantizer may be used for the spectrum encoding. In addition, a trellis coding may also be used for the spectrum encoding, but the spectrum encoding is not limited thereto. Moreover, a variety of spectrum encoding methods may also be used according to either environments in which a corresponding codec is embodied or a user's need. Information on the spectrum encoded by the spectrum coder 517 may be included in the bitstream by the multiplexer 518.

Figure 6:
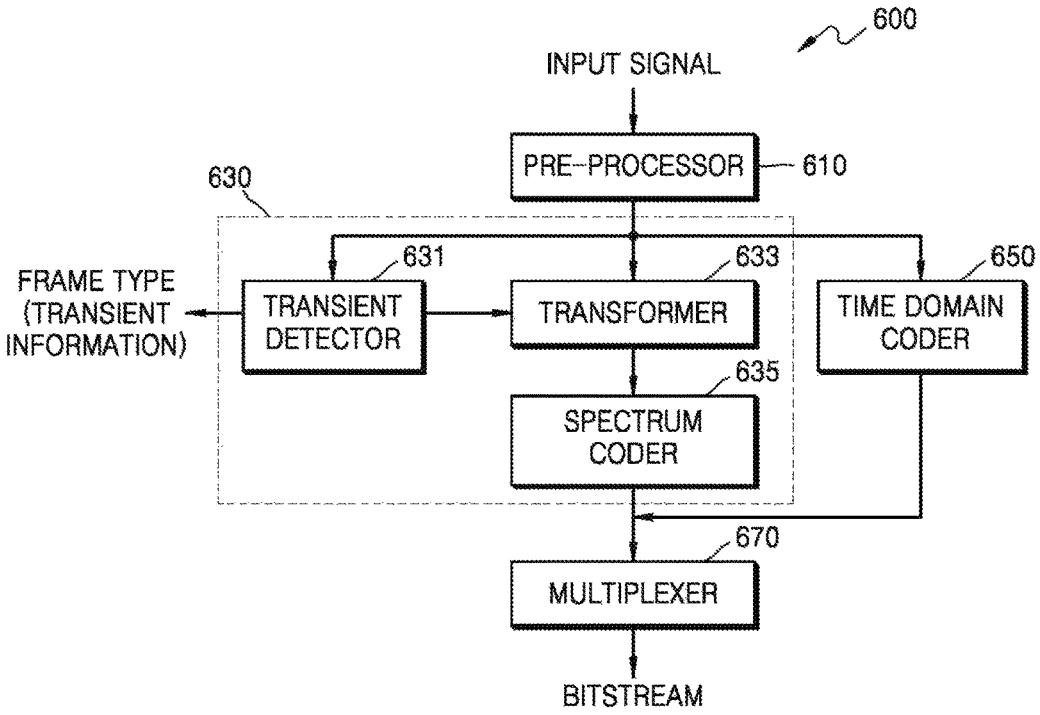
FIG. 6 is a block diagram of a frequency domain audio decoding apparatus according to an exemplary embodiment.

FIG. 6 is a block diagram of a frequency domain audio encoding apparatus according to an exemplary embodiment.

The frequency domain audio encoding apparatus 600 shown in FIG. 6 may include a pre-processor 610, a frequency domain coder 630, a time domain coder 650, and a multiplexer 670. The frequency domain coder 630 may include a transient detector 631, a transformer 633 and a spectrum coder 635. The components may be integrated in at least one module and may be implemented as at least one processor (not shown).

Referring to FIG. 6, the pre-processor 610 may perform filtering, down-sampling, or the like for an input signal, but is not limited thereto. The pre-processor 610 may determine a coding mode according to a signal characteristic. The pre-processor 610 may determine according to a signal characteristic whether a coding mode suitable for a current frame is a speech mode or a music mode and may also determine whether a coding mode efficient for the current frame is a time domain mode or a frequency domain mode. The signal characteristic may be perceived by using a short-term characteristic of a frame or a long-term characteristic of a plurality of frames, but is not limited thereto. For example, if the input signal corresponds to a speech signal, the coding mode may be determined as the speech mode or the time domain mode, and if the input signal corresponds to a signal other than a speech signal, i.e., a music signal or a mixed signal, the coding mode may be determined as the music mode or the frequency domain mode. The pre-processor 610 may provide an input signal to the frequency domain coder 630 when the signal characteristic corresponds to the music mode or the frequency domain mode and may provide an input signal to the time domain coder 660 when the signal characteristic corresponds to the speech mode or the time domain mode.

The frequency domain coder 630 may process an audio signal provided from the pre-processor 610 based on a transform coding scheme. In detail, the transient detector 631 may detect a transient component from the audio signal and determine whether a current frame corresponds to a transient frame. The transformer 633 may determine a length or a shape of a transform window based on a frame type, i.e. transient information provided from the transient detector 631 and may transform the audio signal into a frequency domain based on the determined transform window. As an example of a transform tool, a modified discrete cosine transform (MDCT), a fast Fourier transform (FFT) or a modulated lapped transform (MLT) may be used. In general, a short transform window may be applied to a frame including a transient component. The spectrum coder 635 may perform encoding on the audio spectrum transformed into the frequency domain. The spectrum coder 635 will be described below in more detail with reference to FIGS. 7 and 9.

The time domain coder 650 may perform code excited linear prediction (CELP) coding on an audio signal provided from the pre-processor 610. In detail, algebraic CELP may be used for the CELP coding, but the CELP coding is not limited thereto.

The multiplexer 670 may multiplex spectral components or signal components and variable indices generated as a result of encoding in the frequency domain coder 630 or the time domain coder 650 so as to generate a bitstream. The bitstream may be stored in a storage medium or may be transmitted in a form of packets through a channel.

Figure 7:
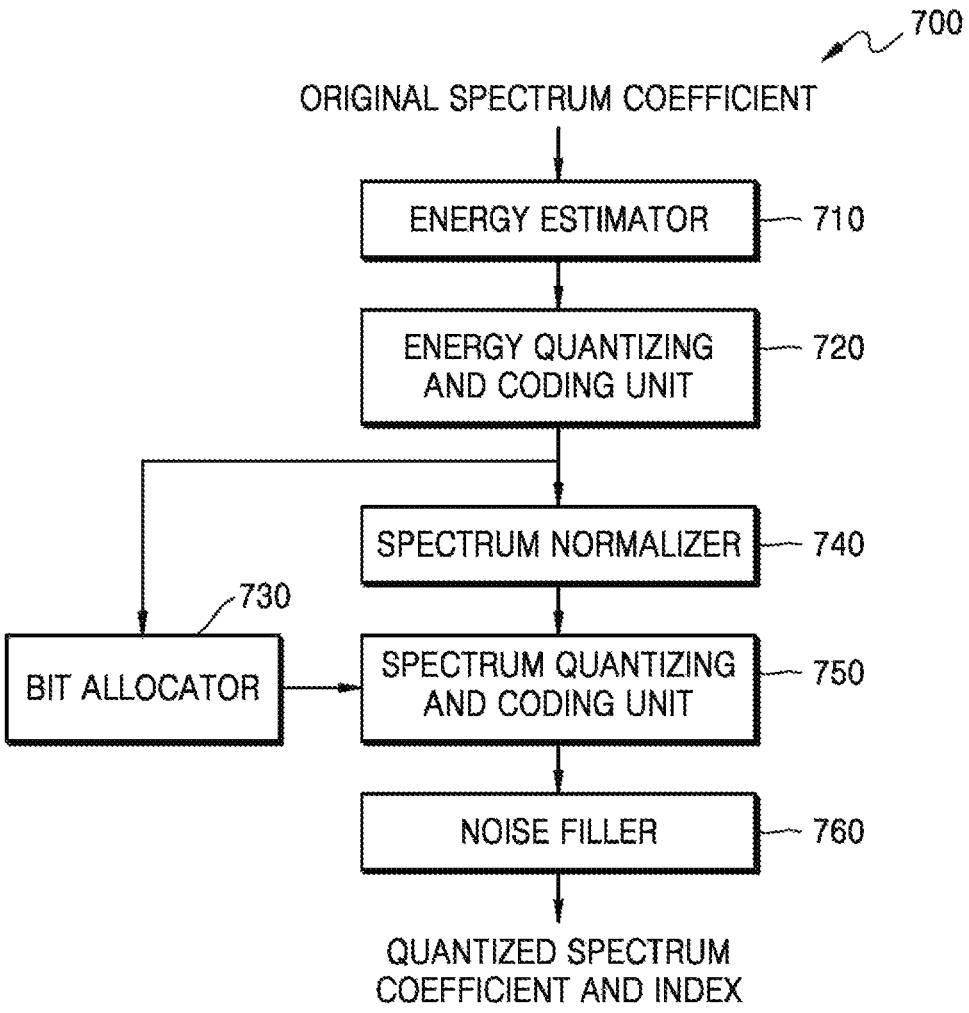
FIG. 7 is a block diagram of a spectrum encoding apparatus according to an exemplary embodiment.

FIG. 7 is a block diagram of a spectrum encoding apparatus according to an exemplary embodiment. The spectrum encoding apparatus shown in FIG. 7 may correspond to the spectrum coder 635 of FIG. 6, may be included in another frequency domain encoding apparatus, or may be implemented independently.

The spectrum encoding apparatus shown in FIG. 7 may include an energy estimator 710, an energy quantizing and coding unit 720, a bit allocator 730, a spectrum normalizer 740, a spectrum quantizing and coding unit 750 and a noise filler 760.

Referring to FIG. 7, the energy estimator 710 may divide original spectral coefficients into a plurality of sub-bands and estimate energy, for example, a Norm value for each sub-band. Each sub-band may have a uniform length in a frame. When each sub-band has a non-uniform length, the number of spectral coefficients included in a sub-band may be increased from a low frequency to a high frequency band.

The energy quantizing and coding unit 720 may quantize and encode an estimated Norm value for each sub-band. The Norm value may be quantized by means of variable tools such as vector quantization (VQ), scalar quantization (SQ), trellis coded quantization (TCQ), lattice vector quantization (LVQ), etc. The energy quantizing and coding unit 720 may additionally perform lossless coding for further increasing coding efficiency.

The bit allocator 730 may allocate bits required for coding in consideration of allowable bits of a frame, based on the quantized Norm value for each sub-band.

The spectrum normalizer 740 may normalize the spectrum based on the Norm value obtained for each sub-band.

The spectrum quantizing and coding unit 750 may quantize and encode the normalized spectrum based on allocated bits for each sub-band.

The noise filler 760 may add noises into a component quantized to zero due to constraints of allowable bits in the spectrum quantizing and coding unit 750.

Figure 8:
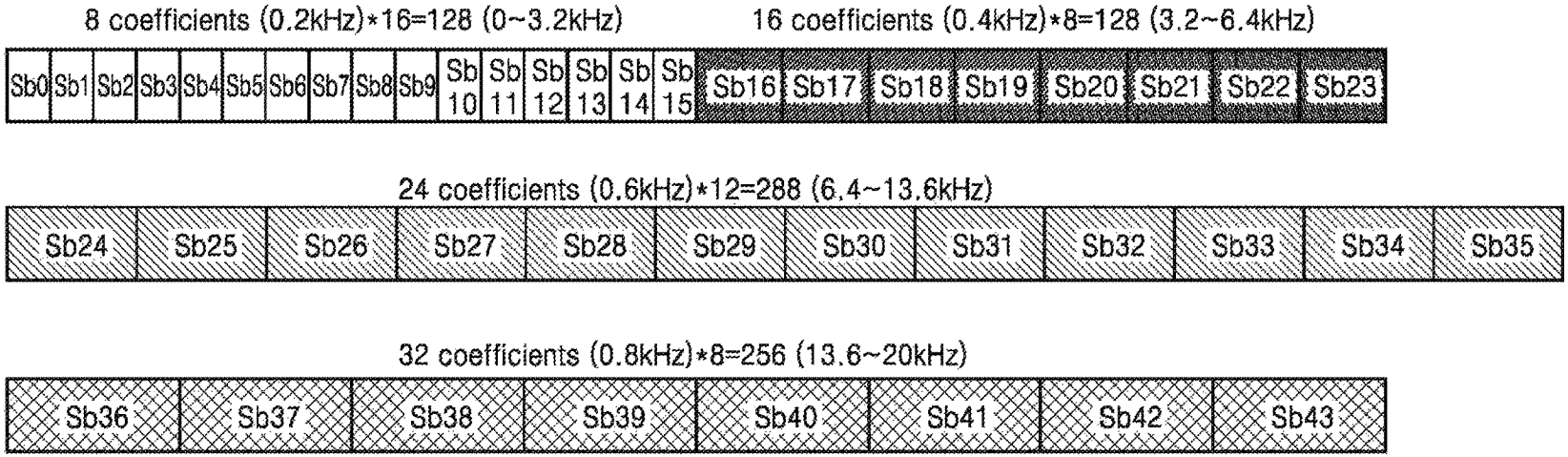
FIG. 8 illustrates sub-band segmentation.

FIG. 8 illustrates sub-band segmentation.

Referring to FIG. 8, when an input signal uses a sampling frequency of 48 KHz and has a frame size of 20 ms, the number of samples to be processed for each frame becomes 960. That is, when the input signal is transformed by using MDCT with 50% overlapping, 960 spectral coefficients are obtained. A ratio of overlapping may be variably set according a coding scheme. In a frequency domain, a band up to 24 KHz may be theoretically processed and a band up to 20 KHz may be represented in consideration of an audible range. In a low band of 0 to 3.2 KHz, a sub-band comprises 8 spectral coefficients. In a band of 3.2 to 6.4 KHz, a sub-band comprises 16 spectral coefficients. In a band of 6.4 to 13.6 KHz, a sub-band comprises 24 spectral coefficients. In a band of 13.6 to 20 KHz, a sub-band comprises 32 spectral coefficients. For a predetermined band set in an encoding apparatus, coding based on a Norm value may be performed and for a high band above the predetermined band, coding based on variable schemes such as band extension may be applied.

Figure 9:
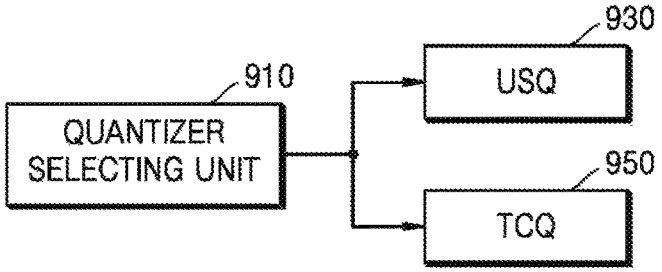
FIG. 9 is a block diagram of a spectrum quantization apparatus according to an exemplary embodiment.

FIG. 9 is a block diagram illustrating a configuration of a spectrum quantization apparatus according to an exemplary embodiment.

The apparatus shown in FIG. 9 may include a quantizer selecting unit 910, a USQ 930, and a TCQ 950.

Figure 10:
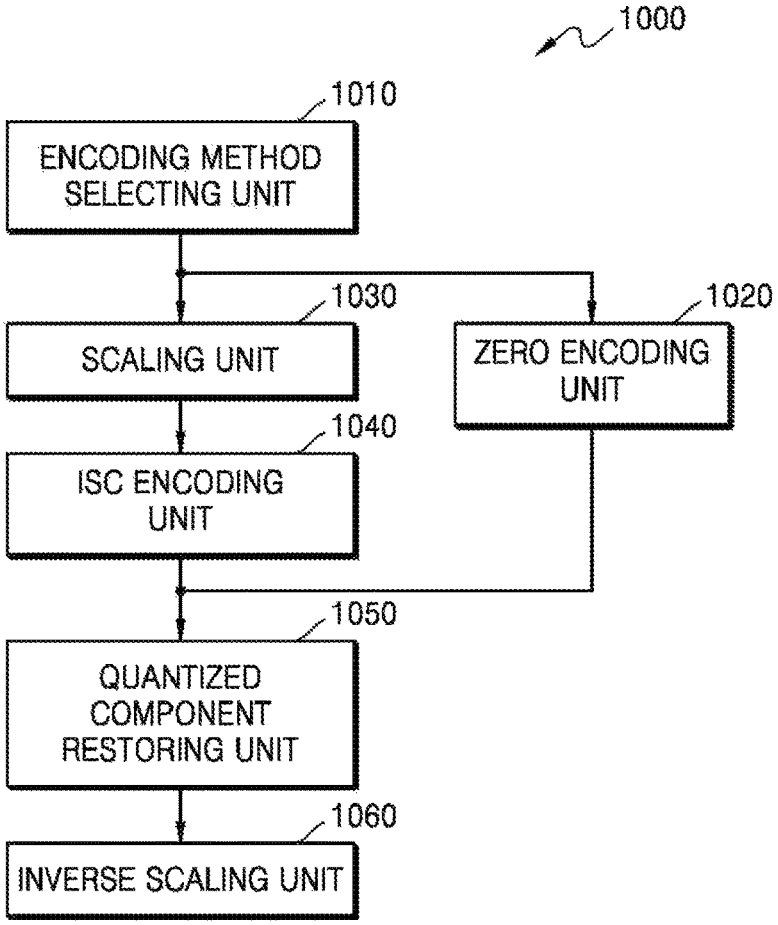
FIG. 10 is a block diagram of a spectrum encoding apparatus according to an exemplary embodiment.

In FIG. 9, the quantizer selecting unit 910 may select the most efficient quantizer from among various quantizers according to the characteristic of a signal to be quantized, i.e. an input signal. As the characteristic of the input signal, bit allocation information for each band, band size information, and the like are usable. According to a result of the selection, the signal to be quantized may be provided to one of the USQ 830 and the TCQ 850 so that corresponding quantization is performed FIG. 10 is a block diagram illustrating a configuration of a spectrum encoding apparatus according to an exemplary embodiment. The apparatus shown in FIG. 10 may correspond to the spectrum quantizing and encoding unit 750 of FIG. 7, may be included in another frequency domain encoding apparatus, or may be independently implemented.

The apparatus shown in FIG. 10 may include an encoding method selecting unit 1010, a zero encoding unit 1020, a scaling unit 1030, an ISC encoding unit 1040, a quantized component restoring unit 1050, and an inverse scaling unit 1060. Herein, the quantized component restoring unit 1050 and the inverse scaling unit 1060 may be optionally provided.

In FIG. 10, the encoding method selection unit 1010 may select an encoding method by taking into account an input signal characteristic. The input signal characteristic may include bits allocated for each band. A normalized spectrum may be provided to the zero encoding unit 1020 or the scaling unit 1030 based on an encoding scheme selected for each band. According to an embodiment, the average number of bits allocated to each sample of a band is greater than or equal to a predetermined value, e.g., 0.75, USQ may be used for the corresponding band by determining that the corresponding band is very important, and TCQ may be used for all the other bands. Herein, the average number of bits may be determined by taking into account a band length or a band size. The selected encoding method may be set using a one-bit flag.

The zero encoding unit 1020 may encode all samples to zero (0) for bands of which allocated bits are zero.

The scaling unit 1030 may adjust a bit rate by scaling a spectrum based on bits allocated to bands. In this case, a normalized spectrum may be used. The scaling unit 1030 may perform scaling by taking into account the average number of bits allocated to each sample, i.e., a spectral coefficient, included in a band. For example, the greater the average number of bits is, the more scaling may be performed.

According to an embodiment, the scaling unit 1030 may determine an appropriate scaling value according to bit allocation for each band.

In detail, first, the number of pulses for a current band may be estimated using a band length and bit allocation information. Herein, the pulses may indicate unit pulses. Before the estimation, bits (b) actually needed for the current band may be calculated based on Equation 1.

$$b = \log_2\left(\sum_{i=1}^{\min(m,n)} 2^i \frac{n!}{(n-i)!i!} \frac{(m-1)!}{(i-1)!(m-i)!}\right) \tag{1}$$

where, n denotes a band length, m denotes the number of pulses, and i denotes the number of non-zero positions having the important spectral component (ISC).

The number of non-zero positions may be obtained based on, for example, a probability by Equation 2.

$$pNZP(i)=2^{i-b}C_n^{\,i}C_{m-1}^{\,i-1},\ i\in\{1,\ldots,\min(m,n)\} \tag{2}$$

In addition, the number of bits needed for the non-zero positions may be estimated by Equation 3.

$$b_{nzp}=\log_2(pNZP(i)) \tag{3}$$

Finally, the number of pulses may be selected by a value b having the closest value to bits allocated to each band.

Next, an initial scaling factor may be determined by the estimation of the number of pulses obtained for each band and an absolute value of an input signal. The input signal may be scaled by the initial scaling factor. If a sum of the numbers of pulses for a scaled original signal, i.e., a quantized signal, is not the same as the estimated number of pulses, pulse redistribution processing may be performed using an updated scaling factor. According to the pulse redistribution processing, if the number of pulses selected for the current band is less than the estimated number of pulses obtained for each band, the number of pulses increases by decreasing the scaling factor, otherwise if the number of pulses selected for the current band is greater than the estimated number of pulses obtained for each band, the number of pulses decreases by increasing the scaling factor. In this case, the scaling factor may be increased or decreased by a predetermined value by selecting a position where distortion of an original signal is minimized.

Since a distortion function for TSQ requires a relative size rather than an accurate distance, the distortion function for TSQ may be obtained a sum of a squared distance between a quantized value and an un-quantized value in each band as shown in Equation 4.

$$d^2 = \sum_{i=1}^{n} (p_i - q_i)^2 \tag{4}$$

where, $p_i$ denotes an actual value, and $q_i$ denotes a quantized value.

A distortion function for USQ may use a Euclidean distance to determine a best quantized value. In this case, a modified equation including a scaling factor may be used to minimize computational complexity, and the distortion function may be calculated by Equation 5.

$$d_1 = \sqrt{\sum_{i=1}^{n} (p_i - g_1 q_i)^2} \tag{5}$$

If the number of pulses for each band dows not match a required value, a predetermined number of pulses may need to be increased or decreased while maintaining a minimal metric. This may be performed in an iterative manner by adding or deleting a single pulse and then repeating until the number of pulses reaches the required value.

To add or delete one pulse, n distortion values need to be obtained to select the most optimum distortion value. For example, a distortion value j may correspond to addition of a pulse to a jth position in a band as shown in Equation 6.

$$d_2^j = \sqrt{\sum_{i=1}^{n} (p_i - g_2\hat{q}_i)^2},\ j = 1 \ldots n \tag{6}$$

To avoid Equation 6 from being performed n times, a deviation may be used as shown in Equation 7.

$$d_2^j = \sqrt{\sum_{i=1}^{n} (p_i - g_2\hat{q}_i)^2} = \tag{7}$$

$$\sum_{i=1}^{n} p_i^2 - 2g_2 \sum_{i=1}^{n} p_i \sum_{i=1}^{n} \hat{q}_i + g_2^2 \sum_{i=1}^{n} \hat{q}_i^2 = \left\{ \sum_{i=1}^{n} \hat{q}_i = \sum_{i=1}^{n} q_i + 1 \right\},$$

$$\left\{ \sum_{i=1}^{n} \hat{q}_i^2 = \sum_{i \in \{1 \ldots n\} i \neq j} q_i^2 + (q_j + 1)^2 = \sum_{i=1}^{n} q_i^2 + 2q_j + 1 \right\} = = \sum_{i=1}^{n} p_i^2 - 2g_2 \left( \sum_{i=1}^{n} q_i p_i + p_j \right) + g_2^2 \left( \sum_{i=1}^{n} q_i^2 + 2q_j + 1 \right), \; j = 1 \ldots nn$$

In Equation 7, $$\sum_{i=1}^{n} q_i^2, \sum_{i=1}^{n} q_i p_i, \sum_{i=1}^{n} p_i^2$$

may be calculated just once. In addition, n denotes a band length, i.e., the number of coefficients in a band, p denotes an original signal, i.e., an input signal of a quantizer, q denotes a quantized signal, and g denotes a scaling factor. Finally, a position j where a distortion d is minimized may be selected, thereby updating $q_j$.

To control a bit rate, encoding may be performed by using a scaled spectiral coefficient and selecting an appropriate ISC. In detail, a spectral component for quantization may be selected using bit allocation for each band. In this case, the spectral component may be selected based on various combinations according to distribution and variance of spectral components. Next, actual non-zero positions may be calculated. A non-zero position may be obtained by analyzing an amount of scaling and a redistribution operation, and such a selected non-zero position may be referred to as an ISC. In summary, an optimal scaling factor and non-zero position information corresponding to ISCs by analyzing a magnitude of a signal which has undergone a scaling and redistribution process. Herein, the non-zero position information indicates the number and locations of non-zero positions. If the number of pulses is not controlled through the scaling and redistribution process, selected pulses may be quantized through a TCQ process, and surplus bits may be adjusted using a result of the quantization. This process may be illustrated as follows.

For conditions that the number of non-zero positions is not the same as the estimated number of pulses for each band and is greater than a predetermined value, e.g., 1, and quantizer selection information indicates TCQ, surplus bits may be adjusted through actual TCQ quantization. In detail, in a case corresponding to the conditions, a TCQ quantization process is first performed to adjust surplus bits. If the real number of pulses of a current band obtained through the TCQ quantization is smaller than the estimated number of pulses previously obtained for each band, a scaling factor is increased by multiplying a scaling factor determined before the TCQ quantization by a value, e.g., 1.1, greater than 1, otherwise a scaling factor is decreased by multiplying the scaling factor determined before the actual TCQ quantization by a value, e.g., 0.9, less than 1. When the estimated number of pulses obtained for each band is the same as the number of pulses of the current band, which is obtained through the TCQ quantization by repeating this process, surplus bits are updated by calculating bits used in the actual TCQ quantization process. A non-zero position obtained by this process may correspond to an ISC.

The ISC encoding unit 1040 may encode information on the number of finally selected ISCs and information on non-zero positions. In this process, lossless encoding may be applied to enhance encoding efficiency. The ISC encoding unit 1040 may perform encoding using a selected quantizer for a non-zero band of which allocated bits are non zero. In detail, the ISC encoding unit 1040 may select ISCs for each band with respect to a normalized spectrum and enode information about the selected ISCs based on number, position, magnitude, and sign. In this case, an ISC magnitude may be encoded in a manner other than number, position, and sign. For example, the ISC magnitude may be quantized using one of USQ and TCQ and arithmetic-coded, whereas the number, positions, and signs of the ISCs may be arithmetic-coded. If it is determined that a specific band includes important information, USQ may be used, otherwise TCQ may be used. According to an embodiment, one of TCQ and USQ may be selected based on a signal characteristic. Herein, the signal characteristic may include a bit allocated to each band or a band length. If the average number of bits allocated to each sample included in a band is greater than or equal to a threshold value, e.g., 0.75, it may be determined that the corresponding band includes vary important information, and thus USQ may be used. Even in a case of a low band having a short band length, USQ may be used in accordance with circumstances. According to another embodiment, one of a first joint scheme and a second joint scheme may be used according to a bandwidth. For example, for an NB and a WB, the first joint scheme in which a quantizer is selected by additionally using secondary bit allocation processing on surplus bits from a previously encoded band in addition to original bit allocation information for each band may be used, and for an SWB and an FB, the second joint scheme in which TCQ is used for a least significant bit (LSB) with respect to a band for which it is determined that USQ is used may be used. In the first joint scheme, the secondary bit allocation processing two bands may be selected by distributing surplus bits from a previously encoded band. In the second joint scheme, USQ may be used for the remaining bits.

The quantized component restoring unit 1050 may restore an actual quantized component by adding ISC position, magnitude, and sign information to a quantized component. Herein, zero may be allocated to a spectral coefficient of a zero position, i.e., a spectral coefficient encoded to zero.

The inverse scaling unit 1060 may output a quantized spectral coefficient of the same level as that of a normalized input spectrum by inversely scaling the restored quantized component. The scaling unit 1030 and the inverse scaling unit 1060 may use the same scaling factor.

Figure 11:
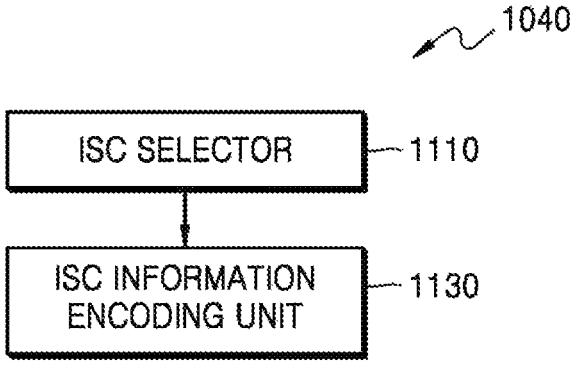
FIG. 11 is a block diagram of an ISC encoding apparatus according to an exemplary embodiment.

FIG. 11 is a block diagram illustrating a configuration of an ISC encoding apparatus according to an exemplary embodiment.

The apparatus shown in FIG. 11 may include an ISC selecting unit 1110 and an ISC information encoding unit 1130. The apparatus of FIG. 11 may correspond to the ISC encoding unit 1040 of FIG. 10 or may be implemented as an independent apparatus.

In FIG. 11, the ISC selecting unit 1110 may select ISCs based on a predetermined criterion from a scaled spectrum to adjust a bit rate. The ISC selecting unit 1110 may obtain actual non-zero positions by analyzing a degree of scaling from the scaled spectrum. Herein, the ISCs may correspond to actual non-zero spectral coefficients before scaling. The ISC selecting unit 1110 may select spectral coefficients to be encoded, i.e., non-zero positions, by taking into account distribution and variance of spectral coefficients based on bits allocated for each band. TCQ may be used for the ISC selection.

The ISC information encoding unit 1130 encode ISC information, i.e., number information, position information, magnitude information, and signs of the ISCs based on the selected ISCs.

Figure 12:
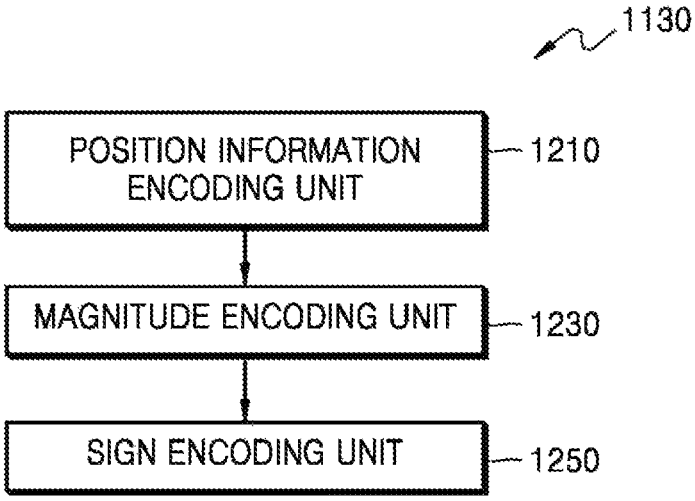
FIG. 12 is a block diagram of an ISC information encoding apparatus according to an exemplary embodiment.

FIG. 12 is a block diagram illustrating a configuration of an ISC information encoding apparatus according to an exemplary embodiment.

The apparatus shown in FIG. 12 may include a position information encoding unit 1210, a magnitude information encoding unit 1230, and a sign encoding unit 1250.

In FIG. 12, the position information encoding unit 1210 may encode position information of the ISCs selected by the ISC selection unit (1110 of FIG. 11), i.e., position information of the non-zero spectral coefficients. The position information may include the number and positions of the selected ISCs. Arithmetic coding may be used for the encoding on the position information. A new buffer may be configured by collecting the selected ISCs. For the ISC collection, zero bands and non-selected spectra may be excluded.

The magnitude information encoding unit 1230 may encode magnitude information of the newly configured ISCs. In this case, quantization may be performed by selecting one of TCQ and USQ, and arithmetic coding may be additionally performed in succession. To increase efficiency of the arithmetic coding, non-zero position information and the number of ISCs may be used.

The sign information encoding unit 1250 may encode sign information of the selected ISCs. Arithmetic coding may be used for the encoding on the sign information.

Figure 13:
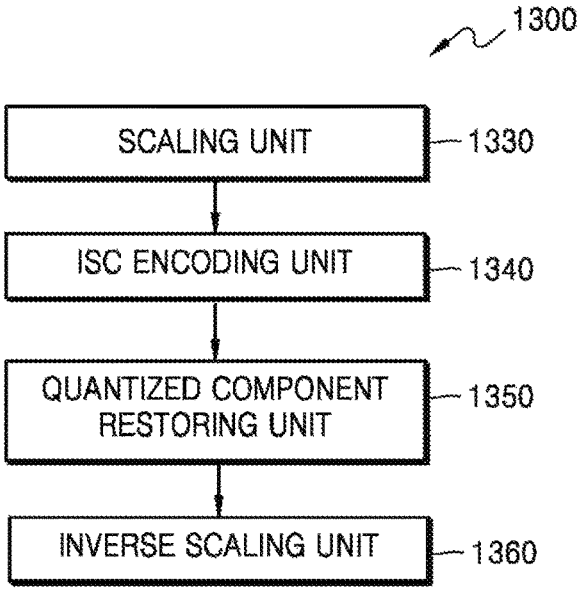
FIG. 13 is a block diagram of a spectrum encoding apparatus according to another exemplary embodiment.

FIG. 13 is a block diagram illustrating a configuration of a spectrum encoding apparatus according to another exemplary embodiment. The apparatus shown in FIG. 13 may correspond to the spectrum quantizing and encoding unit 750 of FIG. 7 or may be included in another frequency domain encoding apparatus or independently implemented.

The apparatus shown in FIG. 13 may include a scaling unit 1330, an ISC encoding unit 1340, a quantized component restoring unit 1350, and an inverse scaling unit 1360. As compared with FIG. 10, an operation of each component is the same except that the zero encoding unit 1020 and the encoding method selection unit 1010 are omitted, and the ISC encoding unit 1340 uses TCQ.

Figure 14:
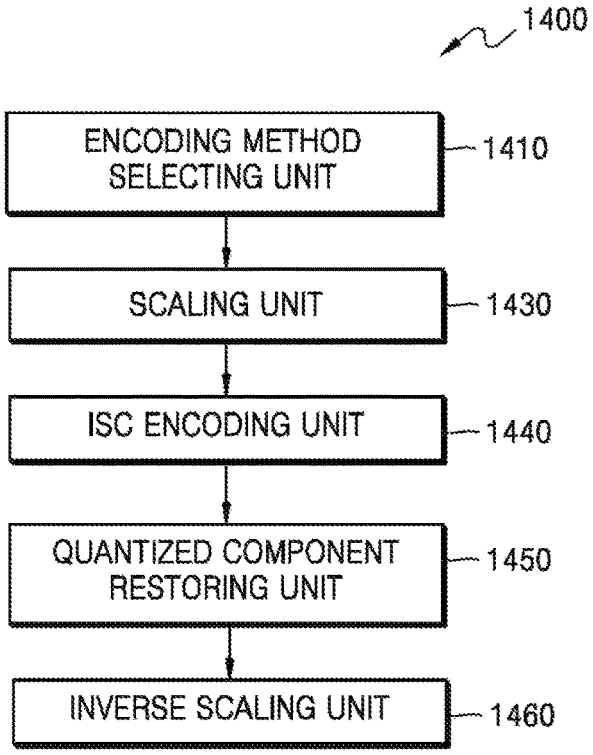
FIG. 14 is a block diagram of a spectrum encoding apparatus according to another exemplary embodiment.

FIG. 14 is a block diagram illustrating a configuration of a spectrum encoding apparatus according to another exemplary embodiment. The apparatus shown in FIG. 14 may correspond to the spectrum quantizing and encoding unit 750 of FIG. 7 or may be included in another frequency domain encoding apparatus or independently implemented.

The apparatus shown in FIG. 14 may include an encoding method selection unit 1410, a scaling unit 1430, an ISC encoding unit 1440, a quantized component restoring unit 1450, and an inverse scaling unit 1460. As compared with FIG. 10, an operation of each component is the same except that the zero encoding unit 1020 is omitted.

Figure 15:
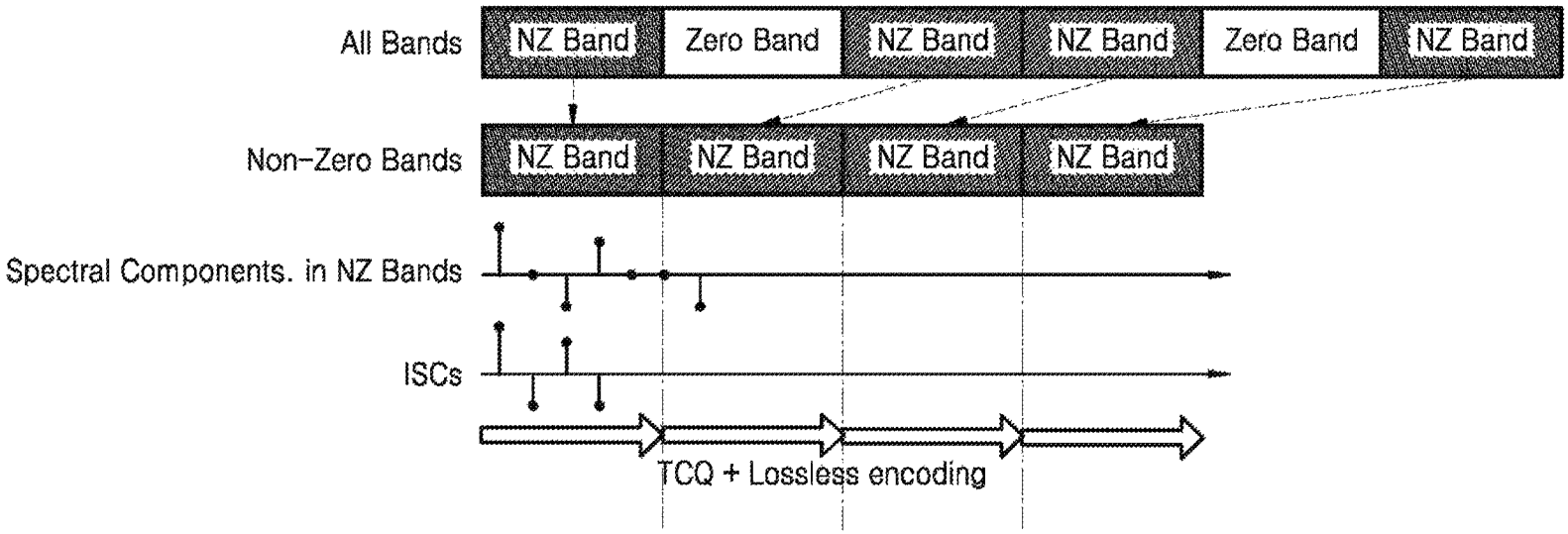
FIG. 15 illustrates a concept of an ISC collection and encoding process according to an exemplary embodiment.

FIG. 15 illustrates a concept of an ISC collecting and encoding process, according to an exemplary embodiment. First, zero bands, i.e., bands to be quantized to zero, are omitted. Next, a new buffer may be configured by using ISCs selected from among spectral components existing in non-zero bands. TCQ and corresponding lossless encoding may be performed on the newly configured ISCs in a band unit.

Figure 16:
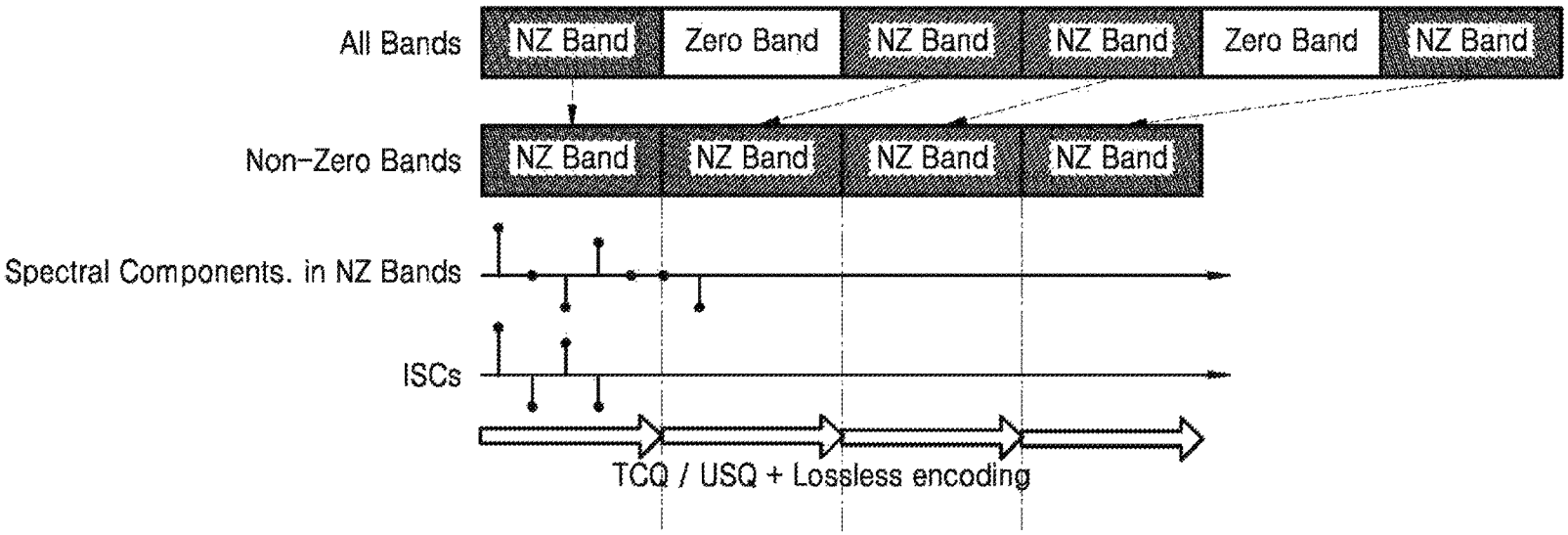
FIG. 16 illustrates a concept of an ISC collection and encoding process according to another exemplary embodiment.

FIG. 16 illustrates a concept of an ISC collecting and encoding process, according to another exemplary embodiment. First, zero bands, i.e., bands to be quantized to zero, are omitted. Next, a new buffer may be configured by using ISCs selected from among spectral components existing in non-zero bands. USC or TCQ and corresponding lossless encoding may be performed on the newly configured ISCs in a band unit.

Figure 17:
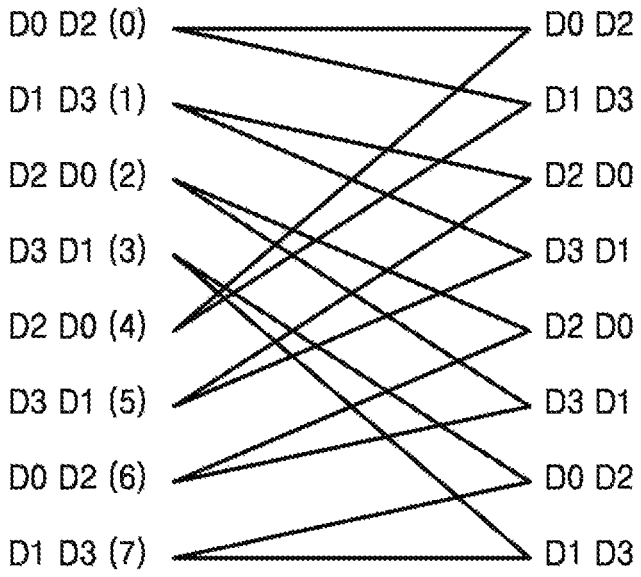
FIG. 17 illustrates TCQ according to an exemplary embodiment.
Figure 17:
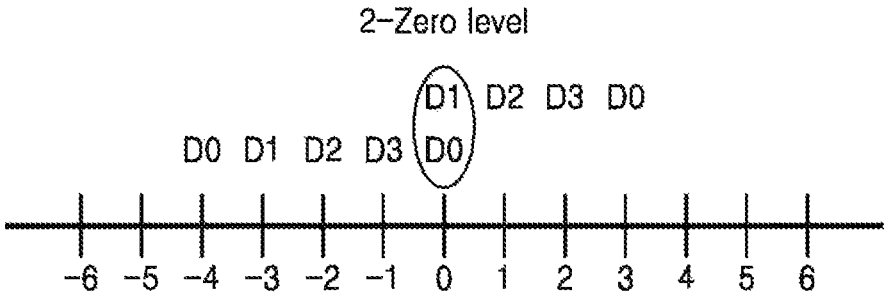

FIG. 17 illustrates TCQ according to an exemplary embodiment, and corresponds to an eight-state and four-coset trellis structure having two zero levels. A detailed description of the corresponding TCQ is disclosed in Paten Registration Number U.S. Pat. No. 7,605,725.

Figure 18:
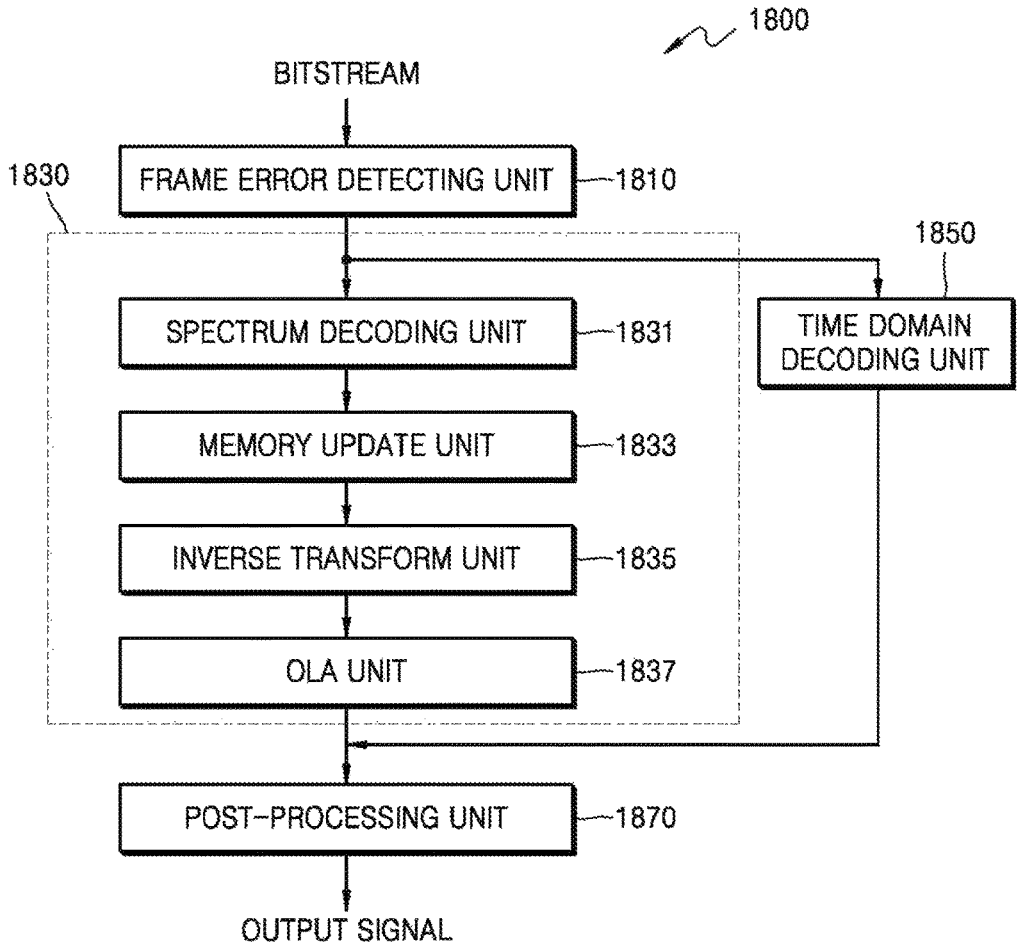
FIG. 18 is a block diagram of a frequency domain audio decoding apparatus according to an exemplary embodiment.

FIG. 18 is a block diagram illustrating a configuration of a frequency domain audio decoding apparatus according to an exemplary embodiment.

A frequency domain audio decoding apparatus 1800 shown in FIG. 18 may include a frame error detecting unit 1810, a frequency domain decoding unit 1830, a time domain decoding unit 1850, and a post-processing unit 1870. The frequency domain decoding unit 1830 may include a spectrum decoding unit 1831, a memory update unit 1833, an inverse transform unit 1835, and an overlap and add (OLA) unit 1837. Each component may be integrated in at least one module and implemented by at least one processor (not shown).

Referring to FIG. 18, the frame error detecting unit 1810 may detect whether a frame error has occurred from a received bitstream.

The frequency domain decoding unit 1830 may operate when an encoding mode is a music mode or a frequency domain mode, enable an FEC or PLC algorithm when a frame error has occurred, and generate a time domain signal through a general transform decoding process when no frame error has occurred. In detail, the spectrum decoding unit 1831 may synthesize a spectral coefficient by performing spectrum decoding using a decoded parameter. The spectrum decoding unit 1831 will be described in more detail with reference FIGS. 19 and 20.

The memory update unit 1833 may update a synthesized spectral coefficient for a current frame that is a normal frame, information obtained using a decoded parameter, the number of continuous error frames till the present, a signal characteristic of each frame, frame type information, or the like for a subsequent frame. Herein, the signal characteristic may include a transient characteristic and a stationary characteristic, and the frame type may include a transient frame, a stationary frame, or a harmonic frame.

The inverse transform unit 1835 may generate a time domain signal by performing time-frequency inverse transform on the synthesized spectral coefficient.

The OLA unit 1837 may perform OLA processing by using a time domain signal of a previous frame, generate a final time domain signal for a current frame as a result of the OLA processing, and provide the final time domain signal to the post-processing unit 1870.

The time domain decoding unit 1850 may operate when the encoding mode is a voice mode or a time domain mode, enable the FEC or PLC algorithm when a frame error has occurred, and generate a time domain signal through a general CELP decoding process when no frame error has occurred.

The post-processing unit 1870 may perform filtering or up-sampling on the time domain signal provided from the frequency domain decoding unit 1830 or the time domain decoding unit 1850 but is not limited thereto. The post-processing unit 1870 may provide a restored audio signal as an output signal.

Figure 19:
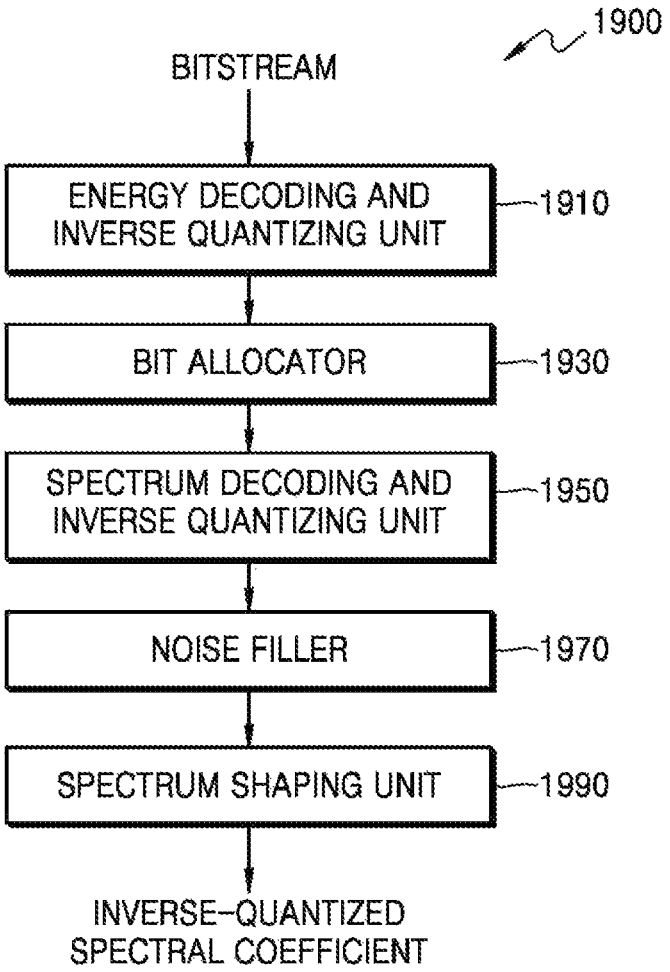
FIG. 19 is a block diagram of a spectrum decoding apparatus according to an exemplary embodiment.

FIG. 19 is a block diagram illustrating a configuration of a spectrum decoding apparatus according to an exemplary embodiment. The apparatus shown in FIG. 19 may correspond to the spectrum decoding unit 1831 of FIG. 18 or may be included in another frequency domain decoding apparatus or independently implemented.

A spectrum decoding apparatus 1900 shown in FIG. 19 may include an energy decoding and inverse quantizing unit 1910, a bit allocator 1930, a spectrum decoding and inverse quantizing unit 1950, a noise filler 1970, and a spectrum shaping unit 1990. Herein, the noise filler 1970 may be located at a rear end of the spectrum shaping unit 1990. Each component may be integrated in at least one module and implemented by at least one processor (not shown).

Referring to FIG. 19, the energy decoding and inverse quantizing unit 1910 may lossless-decode energy such as a parameter for which lossless encoding has been performed in an encoding process, e.g., a Norm value, and inverse-quantize the decoded Norm value. The inverse quantization may be performed using a scheme corresponding to a quantization scheme for the Norm value in the encoding process.

The bit allocator 1930 may allocate bits of a number required for each sub-band based on a quantized Norm value or the inverse-quantized Norm value. In this case, the number of bits allocated for each sub-band may be the same as the number of bits allocated in the encoding process.

The spectrum decoding and inverse quantizing unit 1950 may generate a normalized spectral coefficient by lossless-decoding an encoded spectral coefficient using the number of bits allocated for each sub-band and performing an inverse quantization process on the decoded spectral coefficient.

The noise filler 1970 may fill noise in portions requiring noise filling for each sub-band among the normalized spectral coefficient.

The spectrum shaping unit 1990 may shape the normalized spectral coefficient by using the inverse-quantized Norm value. A finally decoded spectral coefficient may be obtained through a spectral shaping process.

Figure 20:
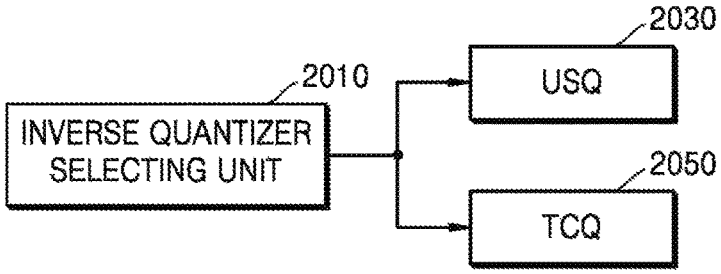
FIG. 20 is a block diagram of a spectrum inverse-quantization apparatus according to an exemplary embodiment.

FIG. 20 is a block diagram illustrating a configuration of a spectrum inverse-quantization apparatus according to an exemplary embodiment.

The apparatus shown in FIG. 20 may include an inverse quantizer selecting unit 2010, a USQ 2030, and a TCQ 2050.

In FIG. 20, the inverse quantizer selecting unit 2010 may select the most efficient inverse quantizer from among various inverse quantizers according to characteristics of an input signal, i.e., a signal to be inverse-quantized. Bit allocation information for each band, band size information, and the like are usable as the characteristics of the input signal. According to a result of the selection, the signal to be inverse-quantized may be provided to one of the USQ 2030 and the TCQ 2050 so that corresponding inverse quantization is performed.

Figure 21:
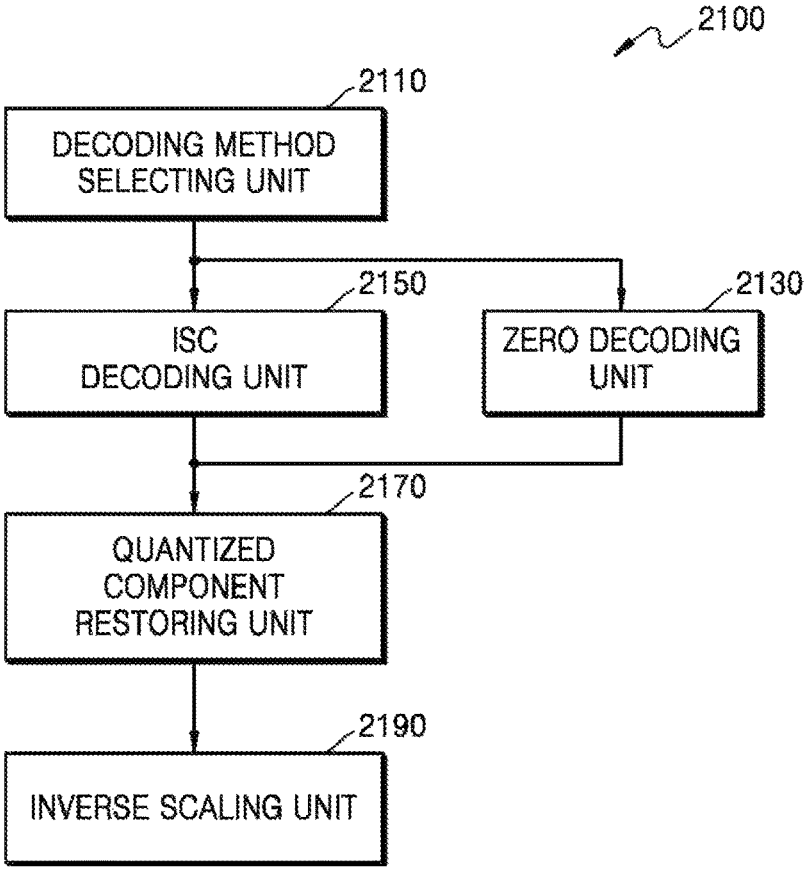
FIG. 21 is a block diagram of a spectrum decoding apparatus according to an exemplary embodiment.

FIG. 21 is a block diagram illustrating a configuration of a spectrum decoding apparatus according to an exemplary embodiment. The apparatus shown in FIG. 21 may correspond to the spectrum decoding and inverse quantizing unit 1950 of FIG. 19 or may be included in another frequency domain decoding apparatus or independently implemented.

The apparatus shown in FIG. 21 may include a decoding method selecting unit 2110, a zero decoding unit 2130, an ISC decoding unit 2150, a quantized component restoring unit 2170, and an inverse scaling unit 2190. Herein, the quantized component restoring unit 2170 and the inverse scaling unit 2190 may be optionally provided.

In FIG. 21, the decoding method selecting unit 2110 may select a decoding method based on bits allocated for each band. A normalized spectrum may be provided to the zero decoding unit 2130 or the ISC decoding unit 2150 based on the decoding method selected for each band.

The zero decoding unit 2130 may decode all samples to zero for bands of which allocated bits are zero.

The ISC decoding unit 2150 may decode bands of which allocated bits are not zero, by using a selected inverse quantizer. The ISC decoding unit 2150 may obtain information about important frequency components for each band of an encoded spectrum and decode the information about the important frequency components obtained for each band, based on number, position, magnitude, and sign. An important frequency component magnitude may be decoded in a manner other than number, position, and sign. For example, the important frequency component magnitude may be arithmetic-decoded and inverse-quantized using one of USQ and TCQ, whereas the number, positions, and signs of the important frequency components may be arithmetic-decoded. The selection of an inverse quantizer may be performed using the same result as in the ISC encoding unit 1040 shown in FIG. 10. The ISC decoding unit 2150 may inverse-quantize the bands of which allocated bits are not zero by using one of TCQ and USQ.

The quantized component restoring unit 2170 may restore actual quantized components based on position, magnitude, and sign information of restored ISCs. Herein, zero may be allocated to zero positions, i.e., non-quantized portions which are spectral coefficients decoded to zero.

The inverse scaling unit (not shown) may be further included to inversely scale the restored quantized components to output quantized spectral coefficients of the same level as the normalized spectrum.

Figure 22:
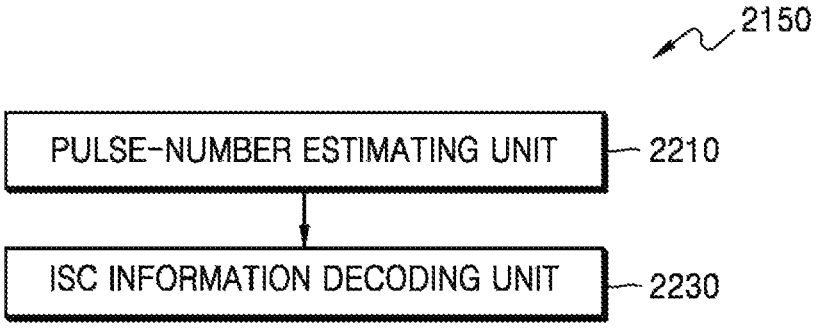
FIG. 22 is a block diagram of an ISC decoding apparatus according to an exemplary embodiment.

FIG. 22 is a block diagram illustrating a configuration of an ISC decoding apparatus according to an exemplary embodiment.

The apparatus shown in FIG. 22 may include a pulse-number estimation unit 2210 and an ISC information decoding unit 2230. The apparatus shown in FIG. 22 may correspond to the ISC decoding unit of FIG. 21 or may be implemented as an independent apparatus.

In FIG. 22, the pulse-number estimation unit 2210 may determine a estimated value of the number of pulses required for a current band by using a band size and bit allocation information. That is, since bit allocation information of a current frame is the same as that of an encoder, decoding is performed by using the same bit allocation information to derive the same estimated value of the number of pulses.

The ISC information decoding unit 2230 may decode ISC information, i.e., number information, position information, magnitude information, and signs of ISCs based on the estimated number of pulses.

Figure 23:
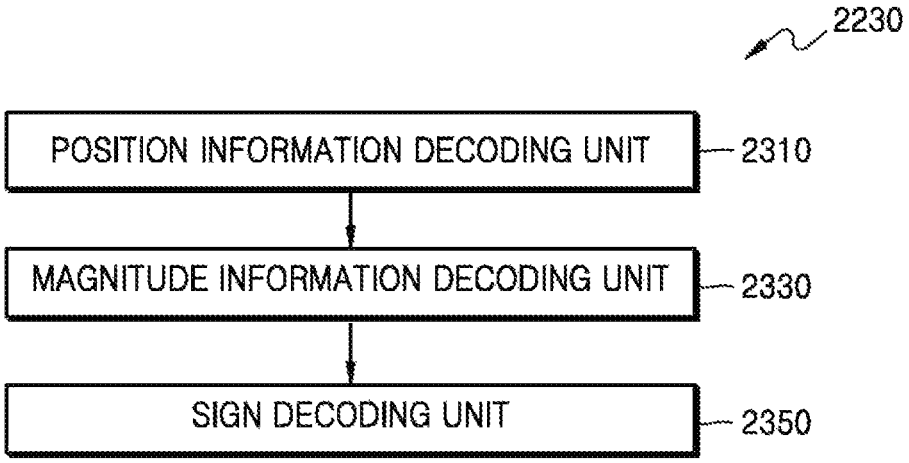
FIG. 23 is a block diagram of an ISC information decoding apparatus according to an exemplary embodiment.

FIG. 23 is a block diagram illustrating a configuration of an ISC information decoding apparatus according to an exemplary embodiment.

The apparatus shown in FIG. 23 may include a position information decoding unit 2310, a magnitude information decoding unit 2330, and a sign decoding unit 2350.

In FIG. 23, the position information decoding unit 2310 may restore the number and positions of ISCs by decoding an index related to position information, which is included in a bitstream. Arithmetic decoding may be used to decode the position information. The magnitude information decoding unit 2330 may arithmetic-decode an index related to magnitude information, which is included in the bitstream and inverse-quantize the decoded index by selecting one of TCQ and USQ. To increase efficiency of the arithmetic decoding, non-zero position information and the number of ISCs may be used. The sign decoding unit 2350 may restore signs of the ISCs by decoding an index related to sign information, which is included in the bitstream. Arithmetic decoding may be used to decode the sign information. According to an embodiment, the number of pulses required for a non-zero band may be estimated and used to decode the position information, the magnitude information, or the sign information.

Figure 24:
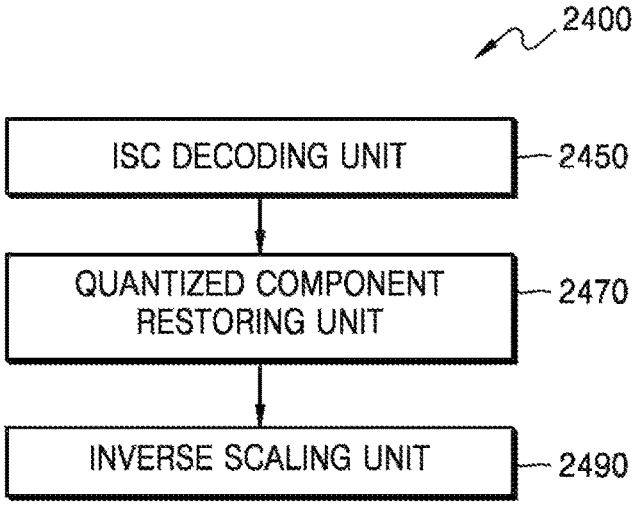
FIG. 24 is a block diagram of a spectrum decoding apparatus according to another exemplary embodiment.

FIG. 24 is a block diagram illustrating a configuration of a spectrum decoding apparatus according to another exemplary embodiment. The apparatus shown in FIG. 24 may correspond to the spectrum decoding and inverse quantizing unit 1950 of FIG. 19 or may be included in another frequency domain decoding apparatus or independently implemented.

The apparatus shown in FIG. 24 may include an ISC decoding unit 2150, a quantized component restoring unit 2170, and an inverse scaling unit 2490. As compared with FIG. 21, an operation of each component is the same except that the decoding method selecting unit 2110 and the zero decoding unit 2130 are omitted, and the ISC decoding unit 2150 uses TCQ.

Figure 25:
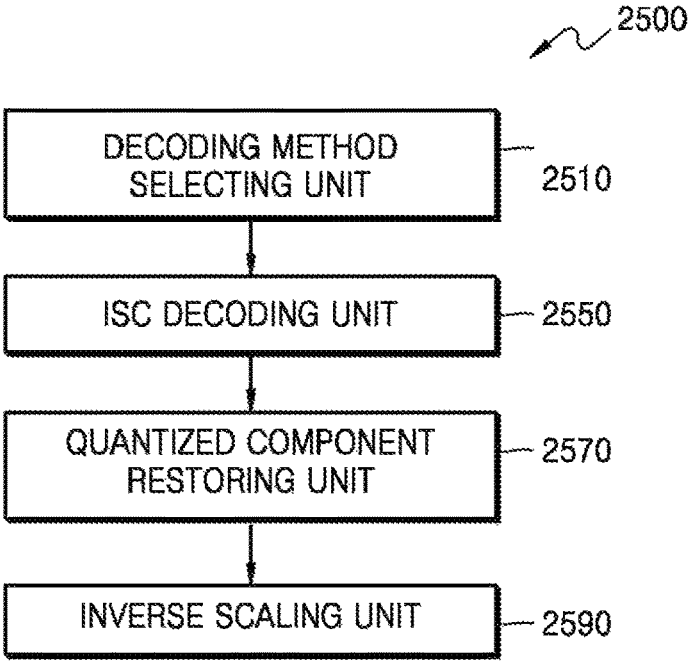
FIG. 25 is a block diagram of a spectrum decoding apparatus according to another exemplary embodiment.

FIG. 25 is a block diagram illustrating a configuration of a spectrum decoding apparatus according to another exemplary embodiment. The apparatus shown in FIG. 25 may correspond to the spectrum decoding and inverse quantizing unit 1950 of FIG. 19 or may be included in another frequency domain decoding apparatus or independently implemented.

The apparatus shown in FIG. 25 may include a decoding method selection unit 2510, an ISC decoding unit 2550, a quantized component restoring unit 2570, and an inverse scaling unit 2590. As compared with FIG. 21, an operation of each component is the same except that the zero decoding unit 2130 is omitted.

Figure 26:
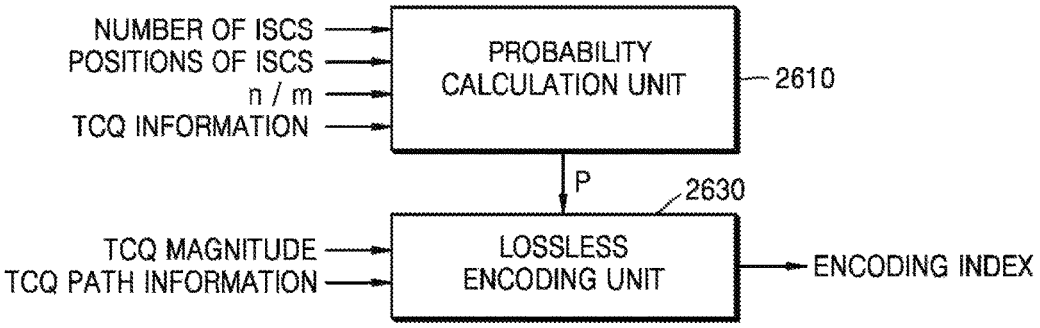
FIG. 26 is a block diagram of an ISC information encoding apparatus according to another exemplary embodiment.

FIG. 26 is a block diagram illustrating a configuration of an ISC information encoding apparatus according to another exemplary embodiment.

The apparatus of FIG. 26 may include a probability calculation unit 2610 and a lossless encoding unit 2630.

In FIG. 26, the probability calculation unit 2610 may calculate a probability value for magnitude encoding according to Equations 8 and 9 by using the number of ISCs, the number of pulses, and TCQ information.

$$\hat{P}_1 = \begin{cases} \dfrac{\hat{l}-1}{\hat{m}-j-1}, & \text{if } (j+1) \in M_S \\ 0, & \text{otherwise} \end{cases} \tag{8}$$

$$\hat{p}_0 = 1 - \hat{p}_1 \tag{9}$$

where $\hat{l}$ denotes the number of ISCs remaining after encoding among ISCs to be transmitted for each band, $\hat{m}$ denotes the number of pulses remaining after encoding among pulses to be transmitted for each band, and $M_s$ denotes a set of existing magnitudes at a trellis state S. Also, j denotes the current coded pulse in magnitude.

The lossless encoding unit 2630 may lossless-encode TCQ magnitude information, i.e., magnitude and path information by using the obtained probability value. The number of pulses of each magnitude is encoded by $\hat{p}_0$ and $\hat{p}_1$ values. Herein, the $\hat{p}_1$ value indicates a probability of a last pulse of a previous magnitude. Also, $\hat{p}_0$ denotes a probability corresponding to the other pulses except for the last pulse. Finally, an index encoded by the obtained probability value is output.

Figure 27:
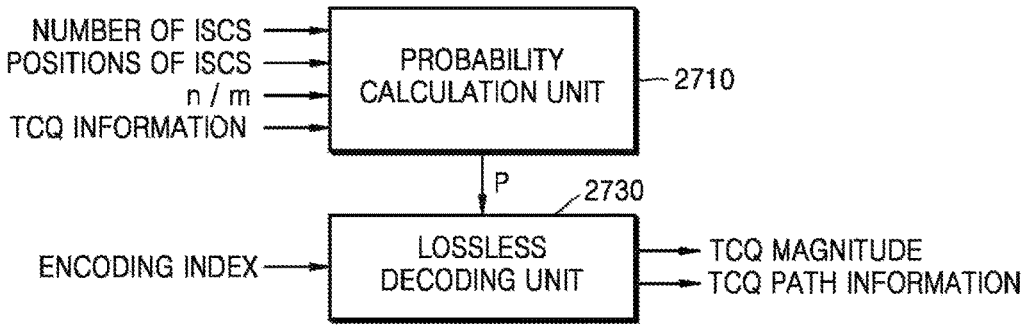
FIG. 27 is a block diagram of an ISC information decoding apparatus according to another illustrating a configuration embodiment.

FIG. 27 is a block diagram illustrating a configuration of an ISC information decoding apparatus according to another exemplary embodiment.

The apparatus of FIG. 27 may include a probability calculation unit 2710 and a lossless decoding unit 2730.

In FIG. 27, the probability calculation unit 2710 may calculate a probability value for magnitude decoding by using ISC information (number i and positions), TCQ information, the number m of pulses, and a band size n. To this end, required bit information b may be obtained using the number of pulses and a band size, which are previously obtained. In this case, Equation 1 may be used. Thereafter, a probability value for magnitude decoding may be calculated based on Equations 8 and 9 by using the obtained bit information b, the number of ISCs, ISC positions, and the TCQ information.

The lossless decoding unit 2730 may lossless-decode TCQ magnitude information, i.e., magnitude information and path information, by using the probability value obtained in the same manner as an encoding apparatus and transmitted index information. To this end, first, an arithmetic coding model for number information is obtained using the probability value, and the TCQ magnitude information is decoded by using the obtained model to decode arithmetic-decode the TCQ magnitude information. In detail, the number of pulses of each magnitude is decoded by $\hat{p}_0$ and $\hat{p}_1$ values. Herein, the $\hat{p}_1$ value indicates a probability of a last pulse of a previous magnitude. Also, $\hat{p}_0$ denotes a probability corresponding to the other pulses except for the last pulse. Finally, the TCQ magnitude information, i.e., magnitude information and path information, decoded by the obtained probability value is output.

Figure 28:
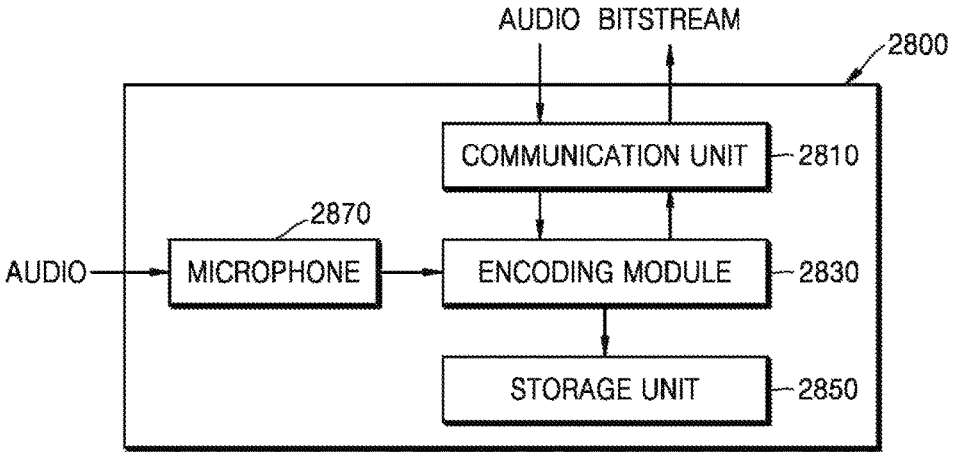
FIG. 28 is a block diagram of a multimedia device according to an illustrating a configuration embodiment.

FIG. 28 is a block diagram of a multimedia device including an encoding module, according to an exemplary embodiment.

Referring to FIG. 28, the multimedia device 2800 may include a communication unit 2810 and the encoding module 2830. In addition, the multimedia device 2800 may further include a storage unit 2850 for storing an audio bitstream obtained as a result of encoding according to the usage of the audio bitstream. Moreover, the multimedia device 2800 may further include a microphone 2870. That is, the storage unit 2850 and the microphone 2870 may be optionally included. The multimedia device 2800 may further include an arbitrary decoding module (not shown), e.g., a decoding module for performing a general decoding function or a decoding module according to an exemplary embodiment. The encoding module 2830 may be implemented by at least one processor (not shown) by being integrated with other components (not shown) included in the multimedia device 2800 as one body.

The communication unit 2810 may receive at least one of an audio signal or an encoded bitstream provided from the outside or may transmit at least one of a reconstructed audio signal or an encoded bitstream obtained as a result of encoding in the encoding module 2830.

The communication unit 2810 is configured to transmit and receive data to and from an external multimedia device or a server through a wireless network, such as wireless Internet, wireless intranet, a wireless telephone network, a wireless Local Area Network (LAN), Wi-Fi, Wi-Fi Direct (WFD), third generation (3G), fourth generation (4G), Bluetooth, Infrared Data Association (IrDA), Radio Frequency Identification (RFID), Ultra WideBand (UWB), Zigbee, or Near Field Communication (NFC), or a wired network, such as a wired telephone network or wired Internet.

According to an exemplary embodiment, the encoding module 1830 may select an ISC in band units for a normalized spectrum and encode information of the selected important spectral component for each band, based on a number, a position, a magnitude, and a sign. A magnitude of an important spectral component may be encoded by a scheme which differs from a scheme of encoding a number, a position, and a sign. For example, a magnitude of an important spectral component may be quantized and arithmetic-coded by using one selected from USQ and TCQ, and a number, a position, and a sign of the important spectral component may be coding by arithmetic coding. According to an exemplary embodiment, the encoding module 2830 may perform scaling on the normalized spectrum based on bit allocation for each band and select an ISC from the scaled spectrum.

The storage unit 2850 may store the encoded bitstream generated by the encoding module 2830. In addition, the storage unit 2850 may store various programs required to operate the multimedia device 2800.

The microphone 2870 may provide an audio signal from a user or the outside to the encoding module 2830.

Figure 29:
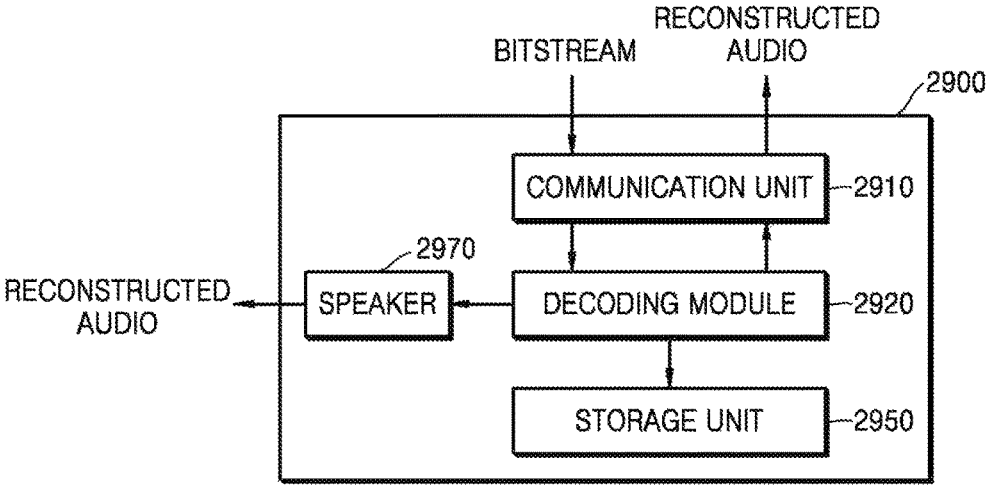
FIG. 29 is a block diagram of a multimedia device according to another illustrating a configuration embodiment.

FIG. 29 is a block diagram of a multimedia device including a decoding module, according to an exemplary embodiment.

Referring to FIG. 29, the multimedia device 2900 may include a communication unit 2910 and a decoding module 2930. In addition, according to the usage of a reconstructed audio signal obtained as a result of decoding, the multimedia device 2900 may further include a storage unit 2950 for storing the reconstructed audio signal. In addition, the multimedia device 2900 may further include a speaker 2970. That is, the storage unit 2950 and the speaker 2970 may be optionally included. The multimedia device 2900 may further include an encoding module (not shown), e.g., an encoding module for performing a general encoding function or an encoding module according to an exemplary embodiment. The decoding module 2930 may be implemented by at least one processor (not shown) by being integrated with other components (not shown) included in the multimedia device 2900 as one body.

The communication unit 1290 may receive at least one of an audio signal or an encoded bitstream provided from the outside or may transmit at least one of a reconstructed audio signal obtained as a result of decoding in the decoding module 2930 or an audio bitstream obtained as a result of encoding. The communication unit 2910 may be implemented substantially and similarly to the communication unit 2800 of FIG. 28.

According to an exemplary embodiment, the decoding module 2930 may receive a bitstream provided through the communication unit 2910 and obtain information of an important spectral component in band units for an encoded spectrum and decode information of the obtained information of the important spectral component, based on a number, a position, a magnitude, and a sign. A magnitude of an important spectral component may be decoded by a scheme which differs from a scheme of decoding a number, a position, and a sign. For example, a magnitude of an important spectral component may be arithmetic-decoded and dequantized by using one selected from the USQ and the TCQ, and arithmetic decoding may be performed for a number, a position, and a sign of the important spectral component.

The storage unit 2950 may store the reconstructed audio signal generated by the decoding module 2930. In addition, the storage unit 2950 may store various programs required to operate the multimedia device 2900.

The speaker 2970 may output the reconstructed audio signal generated by the decoding module 2930 to the outside.

Figure 30:
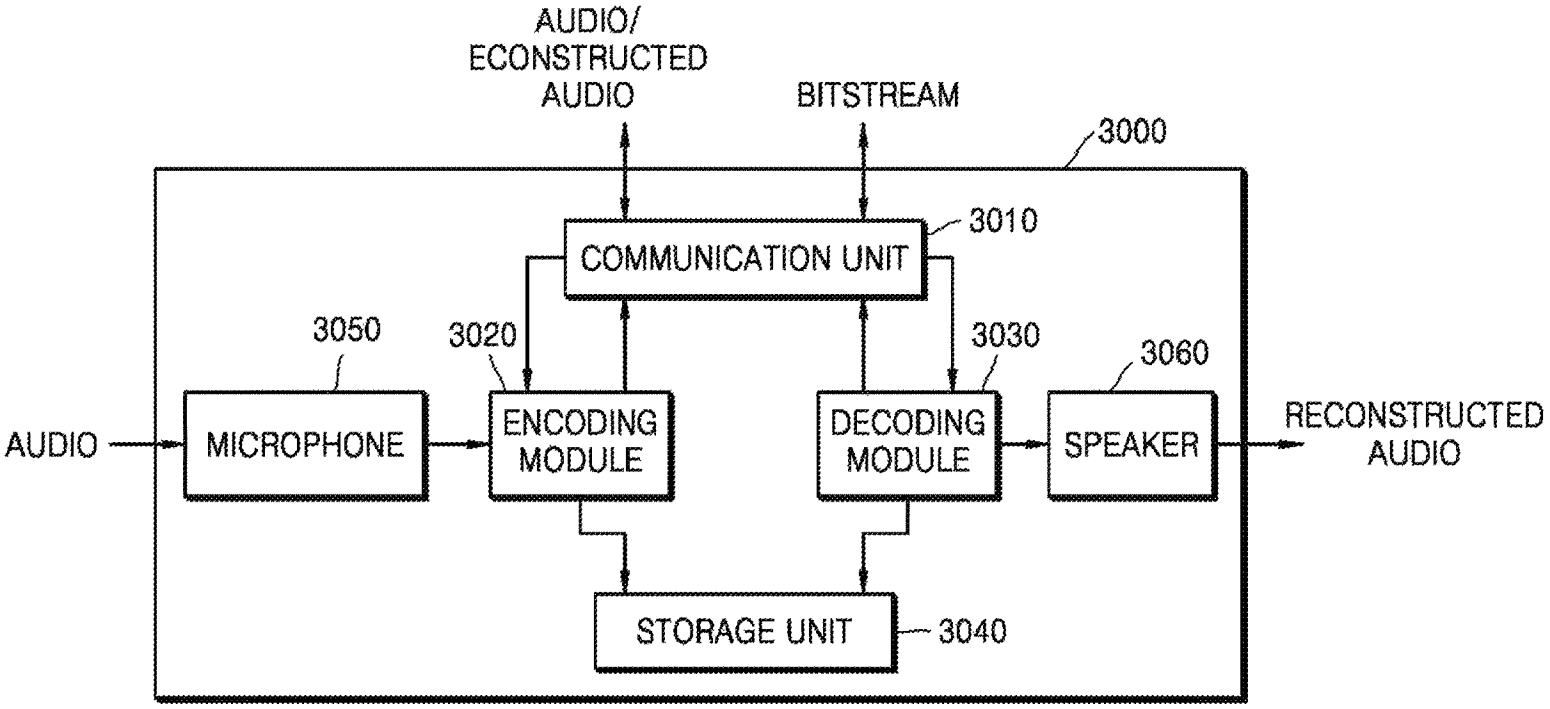
FIG. 30 is a block diagram of a multimedia device according to another illustrating a configuration embodiment.

FIG. 30 is a block diagram of a multimedia device including an encoding module and a decoding module, according to an exemplary embodiment.

Referring to FIG. 30, the multimedia device 3000 may include a communication unit 3010, an encoding module 3020, and a decoding module 3030. In addition, the multimedia device 3000 may further include a storage unit 3040 for storing an audio bitstream obtained as a result of encoding or a reconstructed audio signal obtained as a result of decoding according to the usage of the audio bitstream or the reconstructed audio signal. In addition, the multimedia device 3000 may further include a microphone 3050 and/or a speaker 3060. The encoding module 3020 and the decoding module 3030 may be implemented by at least one processor (not shown) by being integrated with other components (not shown) included in the multimedia device 3000 as one body.

Since the components of the multimedia device 3000 shown in FIG. 30 correspond to the components of the multimedia device 2800 shown in FIG. 28 or the components of the multimedia device 2900 shown in FIG. 29, a detailed description thereof is omitted.

Each of the multimedia devices 2800, 2900, and 3000 shown in FIGS. 28, 29, and 30 may include a voice communication dedicated terminal, such as a telephone or a mobile phone, a broadcasting or music dedicated device, such as a TV or an MP3 player, or a hybrid terminal device of a voice communication dedicated terminal and a broadcasting or music dedicated device but are not limited thereto. In addition, each of the multimedia devices 2800, 2900, and 3000 may be used as a client, a server, or a transducer displaced between a client and a server.

When the multimedia device 2800, 2900, and 3000 is, for example, a mobile phone, although not shown, the multimedia device 2800, 2900, and 3000 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 2800, 2900, and 3000 is, for example, a TV, although not shown, the multimedia device 2800, 2900, or 3000 may further include a user input unit, such as a keypad, a display unit for displaying received broadcasting information, and a processor for controlling all functions of the TV. In addition, the TV may further include at least one component for performing a function of the TV.

Figure 31:
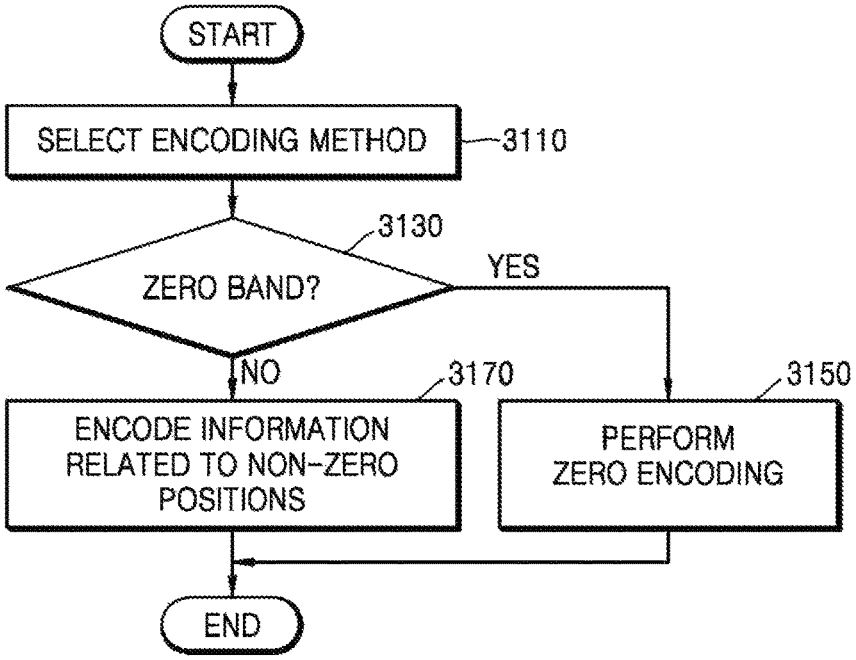
FIG. 31 is a flowchart of a method of encoding a spectral fine structure, according to an illustrating a configuration embodiment.

FIG. 31 is a flowchart illustrating operations of a method of encoding a spectral fine structure, according to an exemplary embodiment.

Referring to FIG. 31, in operation 3110, an encoding method may be selected. To this end, information about each band and bit allocation information may be used. Herein, the encoding method may include a quantization scheme.

In operation 3130, it is determined whether a current band is a band of which bit allocation is zero, i.e., a zero band, and if the current band is a zero band, the method proceeds to operation 3250, otherwise, if the current band is a non-zero band, the method proceeds to operation 3270.

In operation 3150, all samples in the zero band may be encoded to zero.

In operation 3170, the band that is a non-zero band may be encoded based on the selected quantization scheme. According to an embodiment, a final number of pulses may be determined by estimating the number of pulses for each band using a band length and the bit allocation information, determining the number of non-zero positions, and estimating a required number of bits of the non-zero positions. Next, an initial scaling factor may be determined based on the number of pulses for each band and an absolute value of an input signal, and the scaling factor may be updated through a scaling and pulse redistribution process based on the initial scaling factor. A spectral coefficient is scaled using the finally updated scaling factor, and an appropriate ISC may be selected using the scaled spectral coefficient. A spectral component to be quantized may be selected based on the bit allocation information for each band. Next, a magnitude of collected ISCs may be quantized and arithmetic-coded by a USC and TCQ joint scheme. Herein, to increase efficiency of the arithmetic coding, the number of non-zero positions and the number of ISCs may be used. The USC and TCQ joint scheme may include the first joint scheme and the second joint scheme according to bandwidths. The first joint scheme enables selection of a quantizer by using secondary bit allocation processing for surplus bits from a previous band and may be used for an NB and a WB, and the second joint scheme is a scheme in which TCQ is used for an LSB and USQ is used for the other bits with respect to a band determined to use USQ, and may be used for an SWB and an FB. Sign information of selected ISCs may be arithmetic-coded at the same probability for negative and positive signs.

After operation 3170, an operation of restoring quantized components and an operation of inverse-scaling a band may be further included. To restore actual quantized components, position, sign, and magnitude information may be added to the quantized components. Zero may be allocated to zero positions. An inverse scaling factor may be extracted using the same scaling factor as used for scaling, and the restored actual quantized components may be inversely scaled. The inverse-scaled signal may have the same level as that of a normalized spectrum, i.e., the input signal.

An operation of each component of the encoding apparatus described above may be further added to the operations of FIG. 31 in accordance with circumstances.

Figure 32:
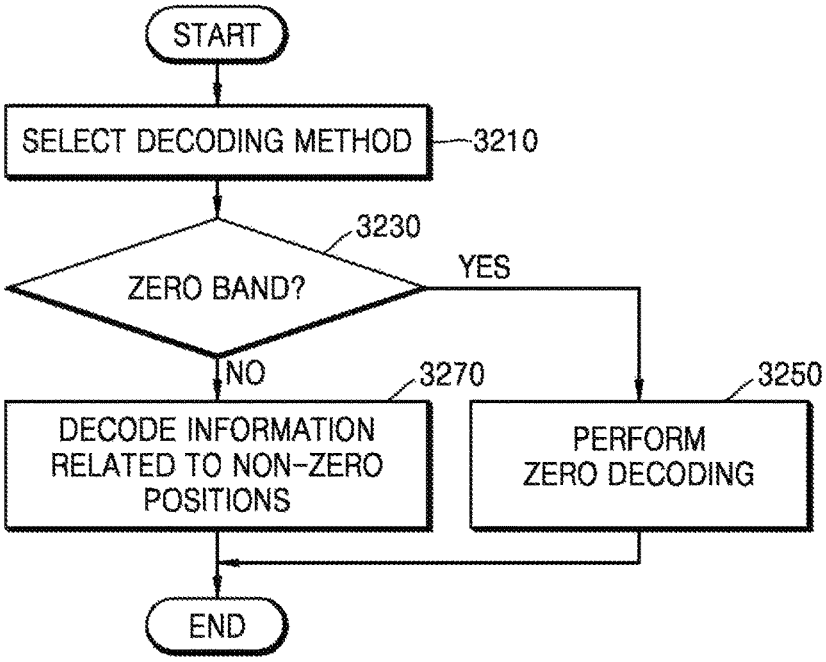
FIG. 32 is a flowchart illustrating operations of a method of decoding a spectral fine structure, according to an illustrating a configuration embodiment.

FIG. 32 is a flowchart illustrating operations of a method of decoding a fine structure of a spectrum, according to an exemplary embodiment. According to the method of FIG. 32, to inverse-quantize a fine structure of a normalized spectrum, ISCs for each band and information about selected ISCs may be decoded based on position, number, sign, and magnitude. Herein, magnitude information may be decoded by arithmetic decoding and the USQ and TCQ joint scheme, and position, number, and sign information is decoded by arithmetic decoding.

In detail, referring to FIG. 32, in operation 3210, a decoding method may be selected. To this end, information about each band and bit allocation information may be used. Herein, the decoding method may include an inverse quantization scheme. The inverse quantization scheme may be selected through the same process as the quantization scheme selection applied to the encoding apparatus described above.

In operation 3230, it is determined whether a current band is a band of which bit allocation is zero, i.e., a zero band, and if the current band is a zero band, the method proceeds to operation 3250, otherwise, if the current band is a non-zero band, the method proceeds to operation 3270.

In operation 3250, all samples in the zero band may be decoded to zero.

In operation 3270, the band that is a non-zero band may be decoded based on the selected inverse quantization scheme. According to an embodiment, the number of pulses for each band may be estimated or determined by using a band length and the bit allocation information. This may be performed through the same process as the scaling applied to the encoding apparatus described above. Next, position information of ISCs, i.e., the number and positions of ISCs may be restored. This is processed similarly to the encoding apparatus described above, and the same probability value may be used for appropriate decoding. Next, a magnitude of collected ISCs may be decoded arithmetic decoding and inverse-quantized by the USC and TCQ joint scheme. Herein, the number of non-zero positions and the number of ISCs may be used for the arithmetic decoding. The USC and TCQ joint scheme may include the first joint scheme and the second joint scheme according to bandwidths. The first joint scheme enables selection of a quantizer by additionally using secondary bit allocation processing for surplus bits from a previous band and may be used for an NB and a WB, and the second joint scheme is a scheme in which TCQ is used for an LSB and USQ is used for the other bits with respect to a band determined to use USQ, and may be used for an SWB and an FB. Sign information of selected ISCs may be arithmetic-decoded at the same probability for negative and positive signs.

After operation 3270, an operation of restoring quantized components and an operation of inverse-scaling a band may be further included. To restore actual quantized components, position, sign, and magnitude information may be added to the quantized components. Bands without having data to be transmitted may be filled with zero. Next, the number of pulses in a non-zero band may be estimated, and position information including the number and positions of ISCs may be decoded based on the estimated number of pulses. Magnitude information may be decoded by lossless decoding and the USC and TCQ joint scheme. For a non-zero magnitude value, signs and quantized components may be finally restored. For restored actual quantized components, inverse scaling may be performed using transmitted norm information.

An operation of each component of the decoding apparatus described above may be further added to the operations of FIG. 32 in accordance with circumstances.

The above-described exemplary embodiments may be written as computer-executable programs and may be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While the exemplary embodiments have been particularly shown and described, it will be understood by those of ordinary skill in the art that various changes in form and details may be made therein without departing from the spirit and scope of the inventive concept as defined by the appended claims. It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

The invention claimed is:

1. A spectrum encoding method for an input signal including at least one of a speech signal and an audio signal in an encoding device comprising:

selecting an encoding method of a band of the input signal based on bit allocation information of the band;

if the selected encoding method of the band is a zero-encoding method, encoding spectral components in the band to zero;

if the selected encoding method is not a zero-encoding method, encoding a magnitude of the spectral components in the band by using one of uniform scalar quantization (USQ) and trellis coded quantization (TCQ) based on an average number of bits allocated to the spectral components of the band; and transmitting a bitstream including a result of the encoding, for reconstruction of the input signal.

2. The spectrum encoding method of claim 1 further comprising encoding information about the spectral components including a number, a position, and a sign of the spectral components if the selected encoding method is not the zero-encoding method.

3. The spectrum encoding method of claim 2, wherein the magnitude of the spectral components is encoded in a scheme other than an encoding scheme of the number, the position, and the sign of the spectral components.

4. The spectrum encoding method of claim 1, wherein the encoding of the magnitude of the spectral components comprises scaling a normalized spectrum based on bits allocated for the band, wherein the spectral components are selected with respect to the scaled spectrum.

* * * * *